US007329990B2

(12) United States Patent
Park

(10) Patent No.: US 7,329,990 B2
(45) Date of Patent: Feb. 12, 2008

(54) PLASMA DISPLAY PANEL HAVING DIFFERENT SIZED ELECTRODES AND/OR GAPS BETWEEN ELECTRODES

(75) Inventor: Hun Gun Park, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 260 days.

(21) Appl. No.: 10/740,426

(22) Filed: Dec. 22, 2003

(65) Prior Publication Data

US 2004/0130269 A1 Jul. 8, 2004

(30) Foreign Application Priority Data

Dec. 27, 2002 (KR) ..... 10-2002-0084783
Oct. 21, 2003 (KR) ..... 10-2003-0073532

(51) Int. Cl.
*H01J 17/49* (2006.01)

(52) U.S. Cl. ..... 313/586; 313/584; 313/505; 313/500; 345/66; 345/77; 345/76

(58) Field of Classification Search ..... 345/66, 345/77, 76, 63, 55, 67, 68; 313/586, 610, 313/609, 620, 621, 584, 505, 500; 315/169.3, 315/169.4
See application file for complete search history.

(56) References Cited

U.S. PATENT DOCUMENTS 4,550,998 A 11/1985 Nishikawa
4,575,751 A 3/1986 Duschl
5,674,553 A 10/1997 Shinoda et al.
5,777,436 A 7/1998 Lepselter
5,852,347 A 12/1998 Marcotte
5,939,826 A 8/1999 Ohsawa et al.
5,982,082 A 11/1999 Janning
6,048,243 A 4/2000 Kosaka et al.
6,055,030 A 4/2000 Izumi
6,097,151 A 8/2000 Kim et al.
6,118,214 A 9/2000 Marcotte
6,259,505 B1 7/2001 Makino
6,275,273 B1 8/2001 Inoue
6,297,590 B1 10/2001 Nanto et al.
6,337,028 B1 1/2002 Masuko et al.
6,353,288 B1 3/2002 Asano et al.
6,380,678 B1 4/2002 Kim
6,580,216 B1 6/2003 Lu et al.
6,597,113 B1 7/2003 Nitta
6,600,265 B1 7/2003 Ebihara et al.
6,621,231 B1 9/2003 Kwon
6,650,051 B1 11/2003 Park et al.
6,720,736 B2 * 4/2004 Lee et al. ..... 315/169.3
6,821,177 B2 11/2004 Mitomo
2001/0050533 A1 * 12/2001 Hirose ..... 313/583

(Continued)

FOREIGN PATENT DOCUMENTS

JP 60-9029 1/1985

(Continued)

*Primary Examiner*—Tuyet Vo
(74) *Attorney, Agent, or Firm*—Ked & Associates, LLP

(57) ABSTRACT

A plasma display for causing a stable discharge at all lines and eliminating a side abnormal discharge is disclosed. In the plasma display, a width of at least one of electrodes at a first scan line selected firstly of scan lines is different from a width of electrodes provided at other scan lines excluding the first scan line.

22 Claims, 28 Drawing Sheets

U.S. PATENT DOCUMENTS

| | | | | |
|---|---|---|---|---|
| 2002/0003515 | A1* | 1/2002 | Lee et al. | 345/60 |
| 2002/0175631 | A1 | 11/2002 | Kim | |
| 2004/0021653 | A1 | 2/2004 | Kim et al. | |

FOREIGN PATENT DOCUMENTS

| | | |
|---|---|---|
| JP | 403167590 | 7/1991 |
| JP | 5-114362 | 5/1993 |
| JP | 8-293253 | 11/1996 |
| JP | 9-129142 | 5/1997 |
| JP | 9-320475 | 12/1997 |
| JP | 10-069858 | 3/1998 |
| JP | 10-269951 | 10/1998 |
| JP | 10-275563 | 10/1998 |
| JP | 11-7897 | 1/1999 |
| JP | 11-25866 | 1/1999 |
| JP | 11-250812 | 9/1999 |
| JP | 11-265661 | 9/1999 |
| KR | 2000-60375 | 10/2000 |
| KR | 2001-48515 | 6/2001 |

* cited by examiner

PLASMA DISPLAY PANEL HAVING DIFFERENT SIZED ELECTRODES AND/OR GAPS BETWEEN ELECTRODES

BACKGROUND OF THE INVENTION

1. Field of the Invention

This invention relates to a plasma display, and more particularly to a plasma display that is adaptive for causing a stable discharge at all lines as well as eliminating a side abnormal discharge.

2. Description of the Related Art

Generally, a plasma display radiates a phosphorous material using an ultraviolet ray with a wavelength of 147 nm generated upon discharge of an inactive mixture gas such as He+Xe, Ne+Xe or He+Ne+Xe, to thereby display a picture including characters and graphics. Such a PDP is easy to be made into a thin-film and large-dimension type. Moreover, the PDP provides a very improved picture quality owing to a recent technical development. Particularly, since a three-electrode, alternating current (AC) surface-discharge PDP has wall charges accumulated in the surface thereof upon discharge and protects electrodes from a sputtering generated by the discharge, it has advantages of a low-voltage driving and a long life.

FIG. 1 is a perspective view showing a cell structure of a conventional plasma display.

Referring to FIG. 1, a discharge cell of the conventional three-electrode, AC surface-discharge PDP includes a scan electrode Y and a sustain electrode Z provided on an upper substrate 10, and an address electrode X provided on a lower substrate 18. The scan electrode Y and the sustain electrode Z include transparent electrodes 12Y and 12Z, and metal bus electrodes 13Y and 13Z having a smaller line width than the transparent electrodes 12Y and 12Z and provided at one edge of the transparent electrodes 12Y and 12Z, respectively.

The transparent electrodes 12Y and 12Z are usually formed from indium-tin-oxide (ITO) on the upper substrate 10. The metal bus electrodes 13Y and 13Z are usually formed from a metal such as chrome (Cr) on the transparent electrodes 12Y and 12Z to thereby reduce a voltage drop caused by the transparent electrodes 12Y and 12Z having a high resistance. On the upper substrate 10 provided with the scan electrode Y and the sustain electrode Z in parallel, an upper dielectric layer 14 and a protective film 16 are disposed. Wall charges generated upon plasma discharge are accumulated into the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode X. The surfaces of the lower dielectric layer 22 and the barrier ribs 24 are coated with a phosphorous material layer 26. The address electrode X is formed in a direction crossing the scan electrode Y and the sustain electrode Z. The barrier rib 24 is formed in a stripe or lattice shape to thereby prevent an ultraviolet ray and a visible light generated by a discharge from being leaked to the adjacent cells. The phosphorous material layer 26 is excited by an ultraviolet ray generated during the plasma discharge to generate any one of red, green and blue visible light rays. An inactive mixture gas is injected into a discharge space defined between the upper and lower substrate 10 and 18 and the barrier rib 24.

Such a PDP makes a time-divisional driving of one frame, which is divided into various sub-fields having a different discharge frequency, so as to express gray levels of a picture. Each sub-field is again divided into a reset period for initializing the entire field, an address period for selecting a scan line and selecting a cell from the selected scan line and a sustain period for realizing the gray levels depending on the discharge frequency. Herein, one scan line includes cells arranged on one line. The cells included in one scan line are scanned by the same scan pulse to simultaneously apply data voltages.

For instance, when it is intended to display a picture of 256 gray levels, a frame interval equal to 1/60 second (i.e. 16.67 msec) is divided into 8 sub-fields SF1 to SF8 as shown in FIG. 2. Each of the 8 sub-fields SF1 to SF8 is divided into a reset period, an address period and a sustain period as mentioned above. Herein, the reset period and the address period of each sub-field are equal every sub-field, whereas the sustain period are increased at a ratio of $2^n$ (wherein n=0, 1, 2, 3, 4, 5, 6 and 7) at each sub-field.

In such a PDP, as shown in FIG. 3A and FIG. 3B, scanning pulses are applied to scan lines sequentially for each line along a specific scanning direction. In other words, the PDP selects cells to be turned on by an address discharge between scanning pulses sequentially applied to the scan electrodes Y and data pulses uniformly applied to the address electrodes X.

However, such a PDP has a problem in that an unstable address discharge is generated at the first scan electrode Y1 or Ym in the scanning direction. More specifically, the remaining scan lines other than a scan line scanned by the first scanning pulse (hereinafter referred to as "first scan line") are supplied with priming charged particles generated by an address discharge at the previous scan line. Thus, the cells at the remaining scan lines other than the first scan line makes use of a priming effect caused by the priming charged particles to thereby cause a stable discharge. However, since the first scan line generates a discharge only by an external voltage without a priming effect caused by the priming charged particles, it causes a more unstable discharge than other scan lines. As a result, the cells at the first scan line causes an unstable address discharge, and causes an unstable sustain discharge because wall charges within the cells generated by the address discharge are small. Due to such a first scan line, it becomes difficult to assure a voltage margin. For instance, the same voltage is applied to the first scan line and other scan lines, then there occurs a phenomenon in which the cell is turned on/off without being turned on at the first scan line unlike other scan lines.

In order to stabilize a discharge at the first scan line, a discharge voltage applied to the first scan line may be raised. However, in this case, power consumption is increased and a voltage margin becomes insufficient due to a rise of the discharge voltage.

In a single scan scheme as shown in FIG. 3A and FIG. 3B, it is difficult to increase the number of sub-fields for the purpose of corresponding to a high resolution of the PDP and improving a picture quality. This is because, if the number of scan lines is more increased or the number of sub-fields is more added as the PDP goes a higher resolution, an address period is lengthened to cause a difficult assurance of the sustain period. In order to overcome a limit of such a single scan scheme, there has been developed a dual scan scheme as shown in FIG. 4A and FIG. 4B. In the dual scan scheme, as shown in FIG. 4A and FIG. 4B, the PDP is divided into two parts of an upper half 30 and a lower half 32 to make a simultaneous scanning on a line-by-line basis at the upper half 30 and the lower half 32, thereby reducing an address period. Each of the upper half 30 and the lower half 32 includes n/2 scan lines when it is assumed that scan lines of the PDP should be n.

However, the dual scan scheme as shown in FIG. 4A and FIG. 4B also has a problem in that an unstable discharge is generated at the first scan line like the single scan scheme. In other words, the PDP adopting the dual scan scheme also cannot use the priming effect at the first scan line unlike other scan lines.

Meanwhile, as shown in FIG. 5 and FIG. 6, a discharge space having the same structure as the cell at a display area 31 is defined at each of the upper outside and the lower outside of the display area 31 including n scan lines. In other words, an upper non-display area 32 and a lower non-display area 33 are provided with address electrodes X and dummy electrode pairs UD1, UD2, BD1 and BD2 and is provided with a dielectric layer covering the electrodes X, UD1, UD2, BD1 and BD2. The dummy electrodes UD1, UD2, BD1 and BD2 provided at the upper non-display area 32 and the lower non-display area 33 cause a discharge at the non-display area during the aging process, thereby stabilizing a discharge characteristic of the cells at the first scan line and the nth scan line of the display area 31 under the same condition as other cells of the display area 31. To this end, the dummy electrodes UD1, UD2, BD1 and BD2 are supplied with a voltage capable of causing a discharge during the aging process. However, there is raised a problem in that the cells of the upper non-display area 32 and the lower non-display area 33 forces the PDP to cause a side abnormal discharge. Such a side abnormal discharge is a discharge generated at the non-display areas 32 and 33 accidentally.

A cause of the side abnormal discharge is as follows. If a discharge is generated within the cells upon driving of the PDP, then space electric charges 61 and 62 caused by the discharge are moved into the upper non-display area 32 and the lower non-display area 33 as shown in FIG. 6, to thereby accumulate the electric charges onto the dielectric layer provided at the cells of the non-display areas 32 and 33. When a wall voltage 62 caused by the electric charges accumulated onto the non-display areas 32 and 33 is raised into more than a discharge voltage Vf capable of causing a discharge, a side abnormal discharge is generated among the electrodes X, UD1, UD2, BD1 and BD2 within the non-display areas 32 and 33. If such a side abnormal discharge occurs at the non-display areas 32 and 33, then a visible light 81 emitted due to the discharge is diffused into the edge of the display area 31 as shown in FIG. 7 to thereby deteriorate a display quality.

SUMMARY OF THE INVENTION

Accordingly, it is an object of the present invention to provide a plasma display that is adaptive for causing a stable discharge at all lines as well as eliminating a side abnormal discharge.

In order to achieve these and other objects of the invention, a plasma display according to one embodiment of the present invention, provided with a plurality of scan lines selected sequentially, includes a plurality of electrodes provided at the respective scan lines, wherein a width of at least one of electrodes at a first scan line selected firstly of the scan lines is different from a width of electrodes provided at other scan lines excluding the first scan line.

In the plasma display, said electrodes includes a scan electrode supplied with a scanning voltage for selecting the scan lines; a sustain electrode parallel to the scan electrode; and an address electrode crossing the scan electrode and the sustain electrode and supplied with a data voltage synchronized with the scanning voltage.

Herein, a width of at least one of the scan electrodes and the sustain electrode at the first scan line is larger than a width of the scan electrodes and the sustain electrodes of said other scan lines.

A width of a portion of an address electrode provided at the first scan line is larger than a width of the address electrodes at the said other scan lines.

A plasma display according to another embodiment of the present invention, provided with a display area including a plurality of scan lines selected sequentially and a non-display area having a discharge space, includes a plurality of electrodes provided at the respective scan lines; and a plurality of dummy electrodes provided at the non-display area, wherein a width of at least one of the dummy electrodes is different from a width of electrodes provided at the display area.

In the plasma display, said electrodes provided at the display area includes a scan electrode supplied with a scanning voltage for selecting the scan lines; a sustain electrode parallel to the scan electrode; and an address electrode crossing the scan electrode and the sustain electrode and supplied with a data voltage synchronized with the scanning voltage.

Herein, said dummy electrodes is parallel to the scan electrode and the sustain electrode provided at the display area, and a width of at least one of the dummy electrodes is larger than a width of the scan electrode and the sustain electrode provided at the display area.

Said address electrode is extended into the non-display area.

Said address electrode has a larger width at a portion within the non-display area than at the display area.

A plasma display according to still another embodiment of the present invention, provided with a plurality of scan lines selected sequentially, includes a plurality of electrode pairs provided at the respective scan lines and opposed, in parallel, to each other, wherein a gap between the electrode pair at a first scan line selected firstly of the scan lines is different from a gap between the electrode pair provided at other scan lines excluding the first scan line.

In the plasma display, a gap between the electrode pair provided at the first scan line is narrower than a gap between the electrode pair provided at said other scan lines.

A plasma display according to still another embodiment of the present invention, provided with a display area including a plurality of scan lines selected sequentially and a non-display area having a discharge space, includes a plurality of electrode pairs provided at the respective scan lines and opposed, in parallel, to each other; and a plurality of dummy electrode pairs provided at the non-display area and opposed, in parallel, to each other, wherein a gap between the dummy electrode pair is different from a gap between the electrode pair provided at the display area.

In the plasma display, a gap between the dummy electrode pair is narrower than a gap between the electrode pair provided at the display area.

A plasma display according to still another embodiment of the present invention, provided with a plurality of scan lines selected sequentially, includes a barrier rib for dividing each cell of the scan lines, wherein a width of the barrier rib provided at a first scan line selected firstly of the scan lines is different from a width of the barrier rib provided at other scan lines excluding the first scan line.

In the plasma display, a portion of the barrier rib provided at the first scan line has a narrower width than the barrier rib provided at said other scan lines.

A plasma display according to still another embodiment of the present invention, provided with a display area including a plurality of scan lines selected sequentially and a non-display area having a discharge space, includes a barrier rib for dividing each cell of the scan lines and a discharge space of the non-display area, wherein the barrier rib at the display area has a width different from the barrier rib at the non-display area.

In the plasma display, a portion of the barrier rib at the non-display area has a narrower width than the barrier rib at the display area.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
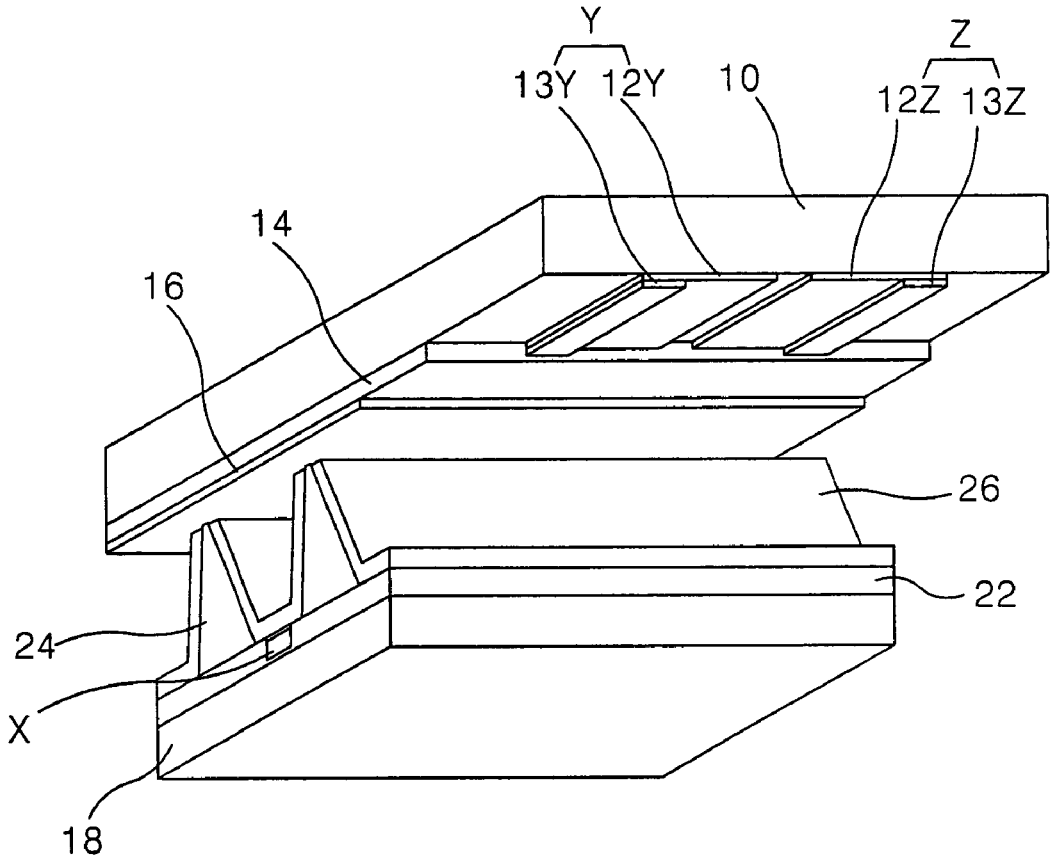
FIG. 1 RELATED ART
FIG. 1 is a perspective view showing a cell structure of a conventional three-electrode AC surface-discharge plasma display.
Figure 2:
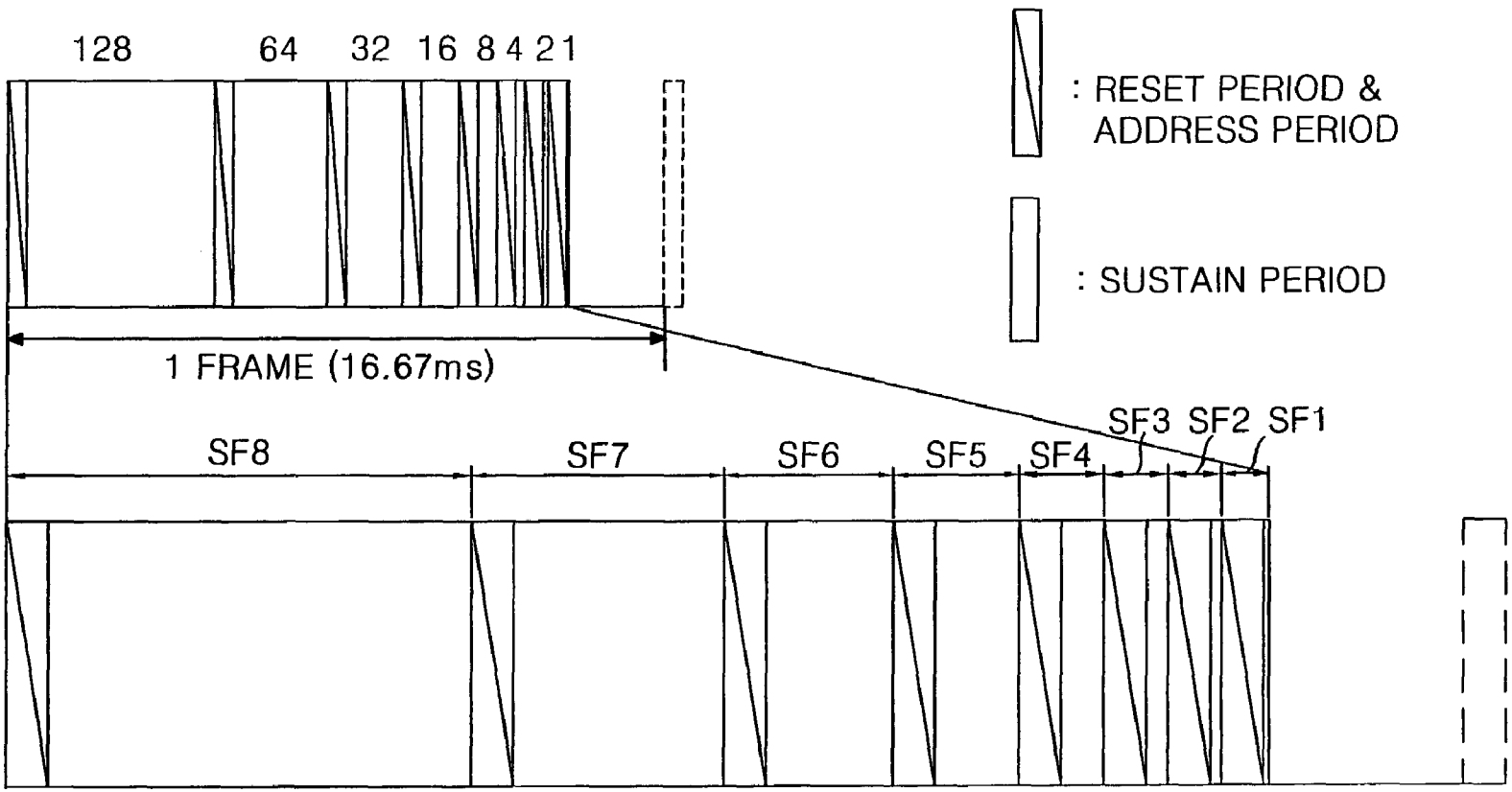
FIG.2 RELATED ART
FIG. 2 depicts one frame of the plasma display.
Figure 3A:
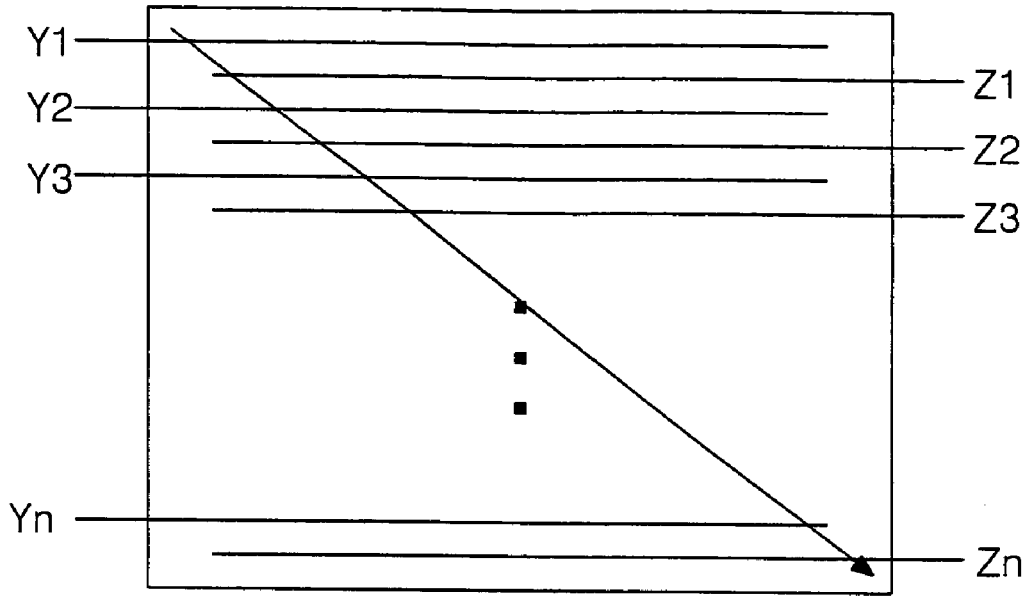
FIG.3A RELATED ART
FIG. 3A and FIG. 3B illustrate scan directions in a single scan scheme.
Figure 3B:
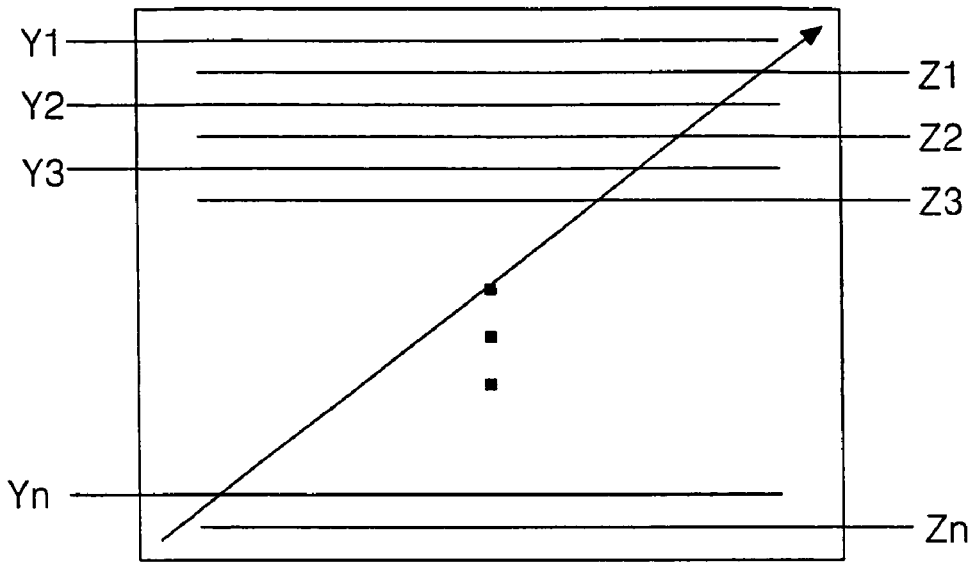
FIG.3B RELATED ART
Figure 4A:
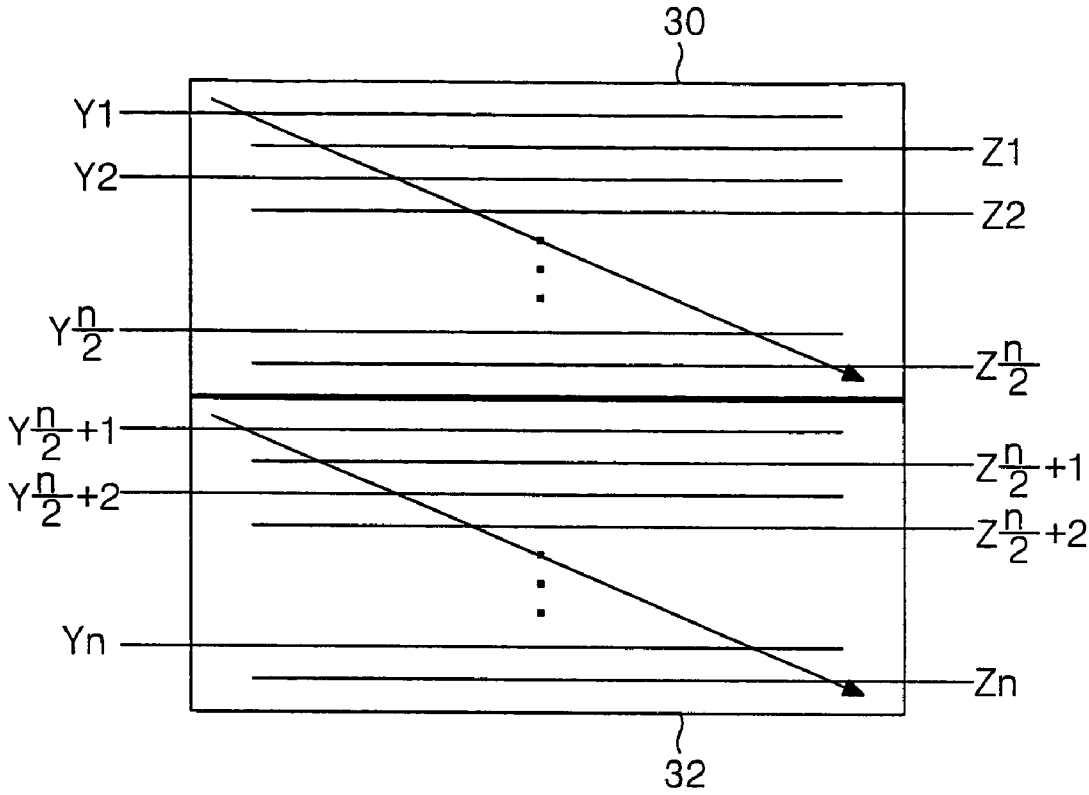
FIG. 4A RELATED ART
FIG. 4A and FIG. 4B illustrate scan directions in a double scan scheme.
Figure 4B:
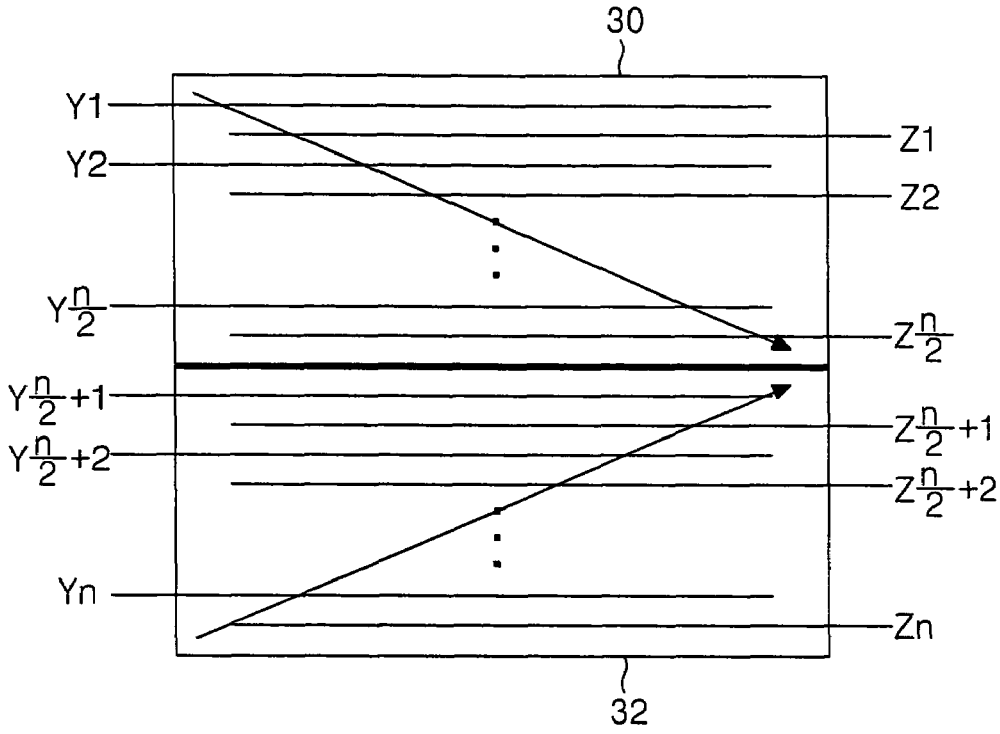
FIG.4B RELATED ART
Figure 5:
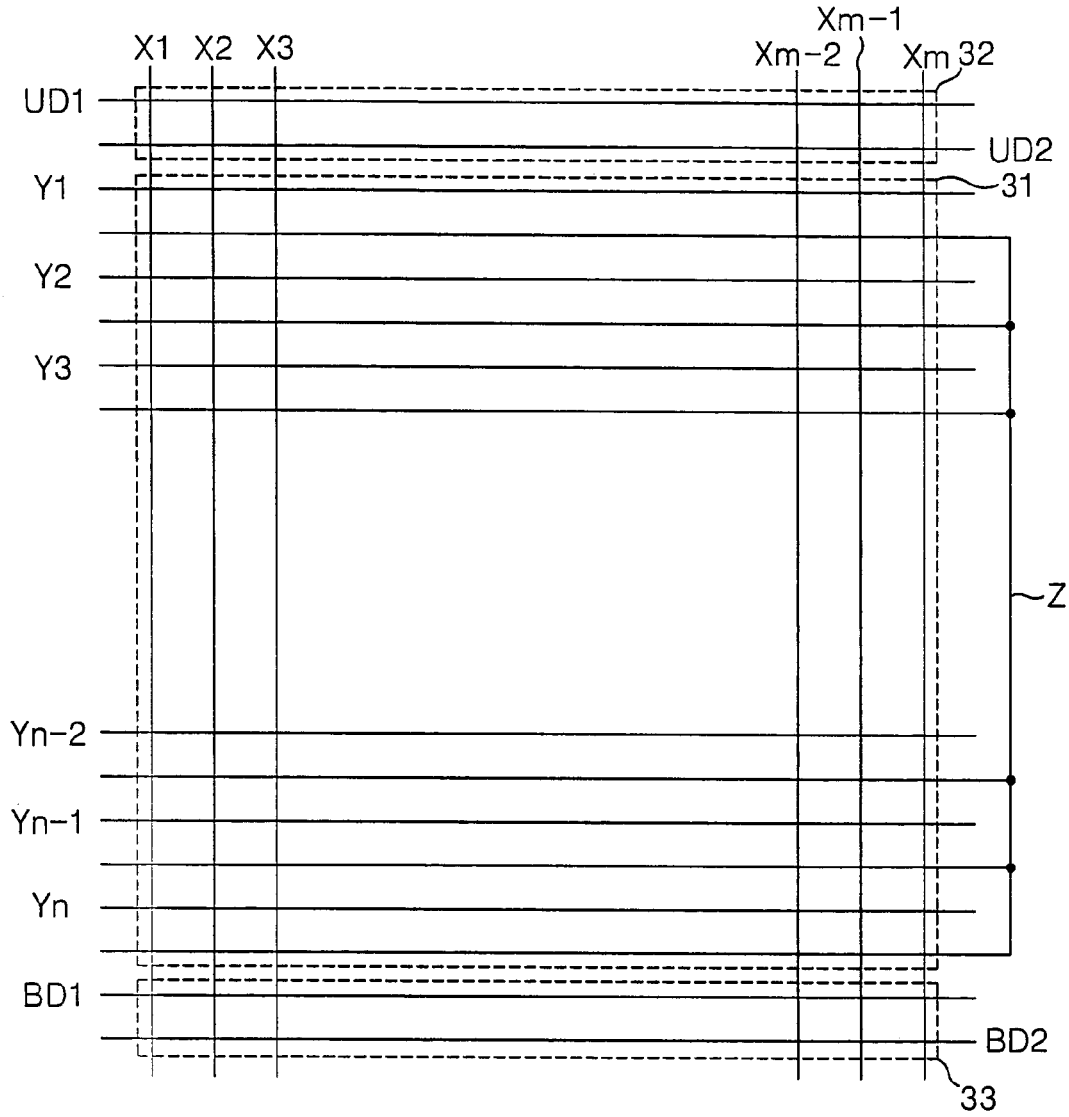
FIG. 5 RELATED ART
FIG. 5 illustrates an electrode arrangement of the plasma display provided with dummy electrodes.
Figure 6:
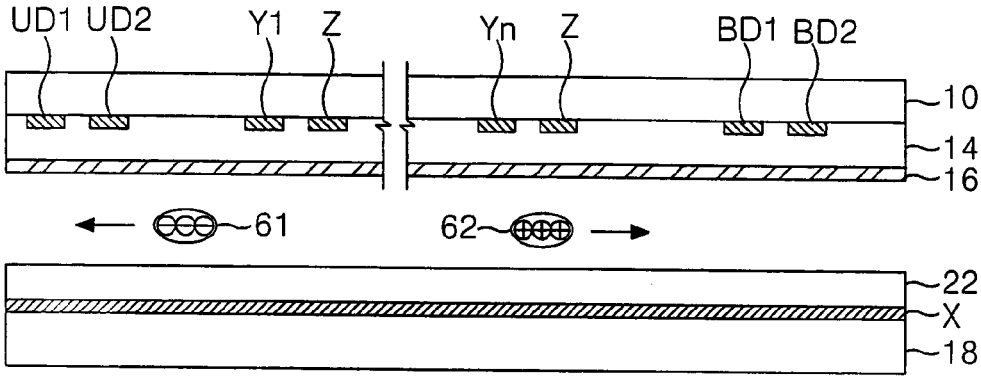
FIG. 6 RELATED ART
FIG. 6 depicts charge particles moved into the non-display area in the plasma display shown in FIG. 5.
Figure 7:
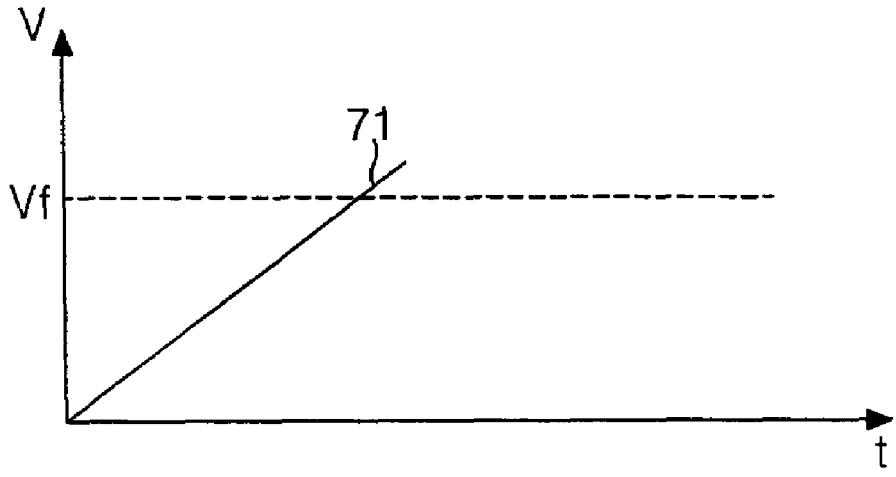
FIG. 7 RELATED ART
FIG. 7 is a graph showing a wall charge raised due to charged particles accumulated onto a space charge of the non-display area.
Figure 8A:
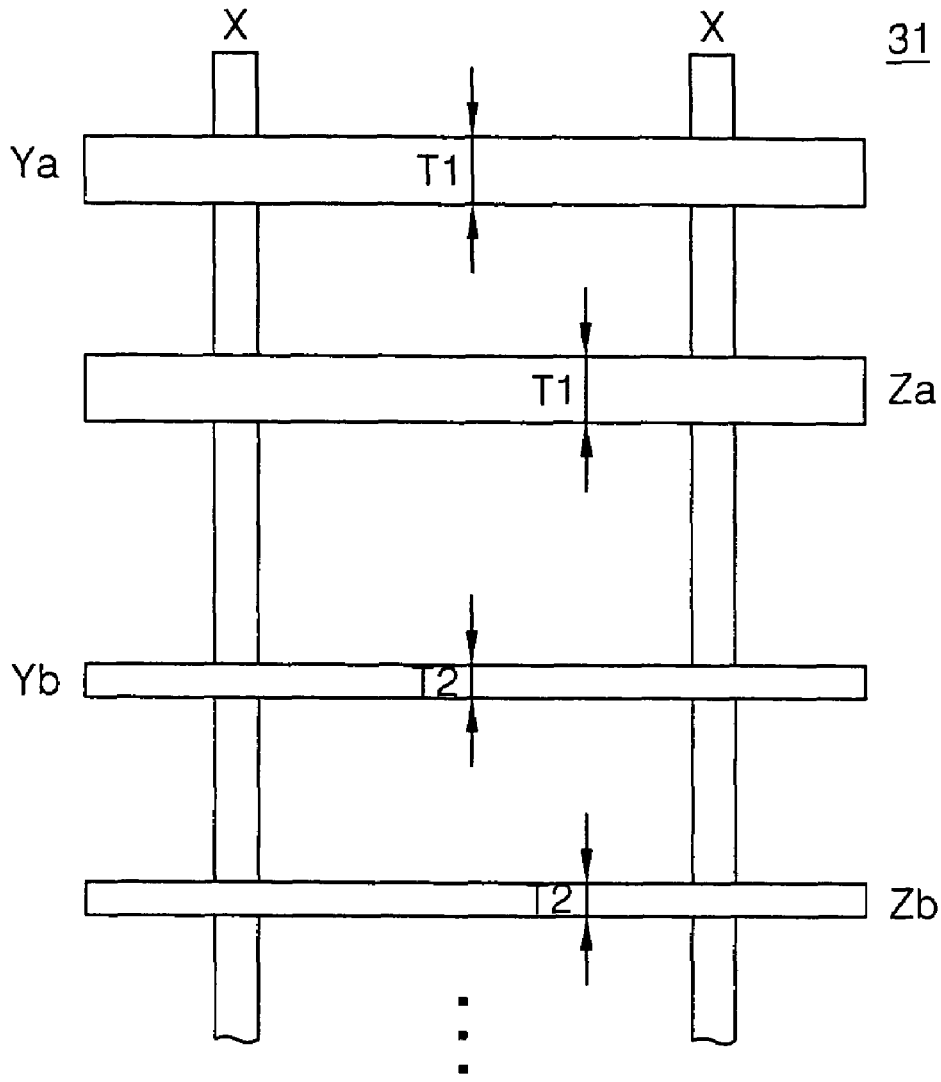
FIG. 8A illustrates a portion of cells in a plasma display according to a first embodiment of the present invention.

Referring to FIG. 8A, in a PDP according to a first embodiment of the present invention, electrodes Ya and Za having a larger width T1 than scan electrode Yb and sustain electrode Zb of other scan lines are provided at the first scan line. Each scan line is provided with an address electrode X crossing the scan electrodes Ya and Yb and the sustain electrodes Za and Zb.

The scan electrodes Ya and Yb are supplied with an initialization waveform for causing an initialization discharge with respect to all the cells in the reset period while being supplied with a scan pulse for selecting the scan line in the address period. Further, the scan electrodes Ya and Yb are supplied with a sustain pulse for causing a sustain discharge with respect to cells selected in the sustain period.

The sustain electrodes Za and Zb are supplied with a sustain pulse for causing a sustain discharge with respect to cells selected in the sustain period.

The address electrode X is supplied with a data pulse synchronized with the scan pulse in the address period.

If a width T1 of the scan electrode Ya and the sustain electrode Za provided at the first scan line is larger than a width T2 of the scan electrode Yb and the sustain electrode Zb provided at other scan lines as shown in FIG. 8A, wall charges formed by the initialization discharge at the first scan line are more increased in comparison with other scan lines. If a scanning pulse is applied to the scan electrodes Ya and Yb and, at the same time, a data pulse is applied to the address electrode X, then an address discharge between the scan electrode Ya and the address electrode X generated at the first scan line becomes stable even with no priming effect. Accordingly, an address discharge is generated by compensating for an absence of the priming effect to cause a uniform and stable address discharge at all the lines, so that a sustain discharge is stabilized and voltages supplied from the exterior to cause a discharge, that is, a scan voltage, a data voltage and a sustain voltage, etc. have a wide voltage margin.

Figure 8B:
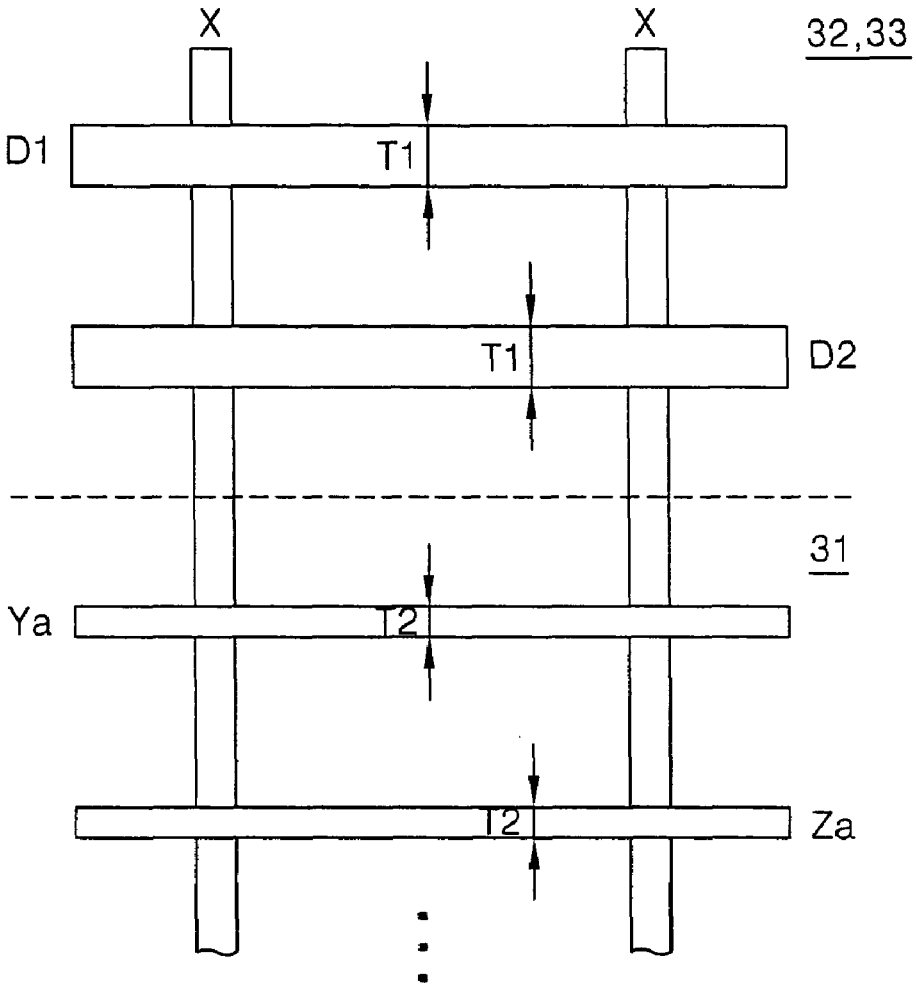
FIG. 8B illustrates a portion of cells in a plasma display according to a second embodiment of the present invention.

FIG. 8B shows a portion of cells in a PDP according to a second embodiment of the present invention.

Referring to FIG. 8B, in the PDP according to the second embodiment of the present invention, dummy electrodes D1 and D2 having a wider width T1 than a scan electrode Ya and a sustain electrode Za provided at the first scan line of a display area 31 are provided at non-display areas 32 and 33. The display area and the non-display areas 32, 33 are provided with an address electrode X crossing the scan electrode Ya, the sustain electrode Za and the dummy electrodes D1 and D2.

The scan electrode Ya is supplied with an initialization waveform for causing an initialization discharge with respect to all the cells in the reset period while being supplied with a scan pulse for selecting the scan line in the address period. Further, the scan electrode Ya is supplied with a sustain pulse for causing a sustain discharge with respect to cells selected in the sustain period.

The sustain electrodes Za and Zb are supplied with a sustain pulse for causing a sustain discharge with respect to cells selected in the sustain period.

The address electrode X is supplied with a data pulse synchronized with the scan pulse in the address period.

At least one of the dummy electrodes D1 and D2 is supplied with an initialization waveform in the reset period and a scan pulse in the address period. Further, the dummy electrodes D1 and D2 are supplied with an initialization waveform in the reset period and an erasure voltage for erasing electric charges left at a discharge space within the non-display area in the late part of the sustain period or in a separate erasure period.

If a width T1 of the dummy electrodes D1 and D2 of the non-display areas 32 and 33 adjacent to the first scan line is larger than a width T2 of the scan electrode Ya and the sustain electrode Za provided at the first scan line as shown in FIG. 8B; and a scan pulse is simultaneously applied to at least one of the dummy electrodes D1 and D2 and the scan electrode Ya and a data pulse is applied to the address electrode X, then a discharge is generated at the discharge space of the non-display area at almost a same time with the address discharge of the first scan line. Space charges produced at the discharge space of the non-display area in this manner are moved into cells of the first scan line, thereby exerting a priming effect on the cells of the first scan line.

Figure 9:
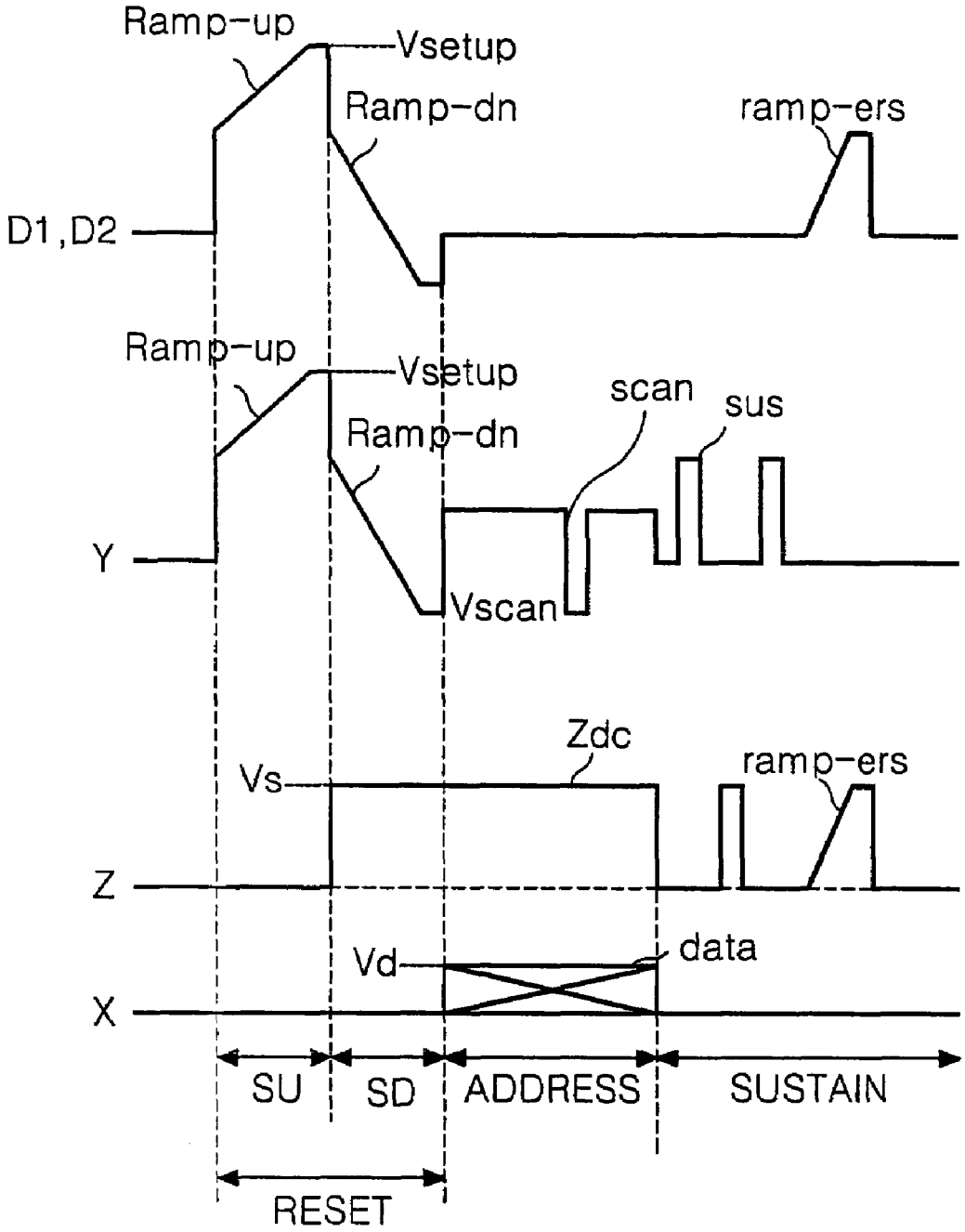
FIG. 9 is a waveform diagram of driving signals applied to the electrodes of the plasma display according to the embodiments of the present invention.

Furthermore, if a width T1 of the dummy electrodes D1 and D2 of the non-display areas 32 and 33 adjacent to the first scan line is larger than a width T2 of the scan electrode Ya and the sustain electrode Za provided at the first scan line as shown in FIG. 8B; and an initialization voltage as shown in FIG. 9 is simultaneously applied to at least one of the dummy electrodes D1 and D2 and the scan electrode Ya or an erasure voltage as shown in FIG. 9 is at least one of the dummy electrodes D1 and D2, then electric charges left within the discharge spaces of the non-display areas 32 and 33 can be erased, to thereby prevent a generation of side abnormal discharge.

FIG. 9 shows an example of a driving waveform applied to each electrode of the PDP according to the embodiment of the present invention.

Referring to FIG. 9, the PDP includes a reset period for initializing cells of the entire field, an address period for selecting the cell and a sustain period for sustaining a discharge of the selected cell for its driving.

The reset period is divided into a set-up interval SU for causing a writing discharge and a set-down interval SD for causing an erasure discharge. In the set-up interval SU, a rising ramp waveform Ramp-up is simultaneously applied to the scan electrodes Y. At the same time, 0[V] is supplied to the scan electrodes Z and the address electrodes X. The rising ramp waveform Ramp-up allows a dark discharge in which a light is almost not generated to cause between the scan electrode Y and the address electrode X and between the scan electrode Y and the sustain electrode Z within the cells of the entire field. This set-up discharge allows positive (+) wall charges to be accumulated onto the address electrode X and the sustain electrode Z while allowing negative (−) wall charges to be accumulated onto the scan electrode Y. In the set-down interval SD, a falling ramp waveform Ramp-dn beginning to drop from a positive voltage lower than a peak voltage of the rising ramp waveform Ramp-up and dropping until a ground voltage GND or a specific negative voltage level is simultaneously applied to the scan electrodes Y. At the same time, a positive sustain voltage Vs is applied to the sustain electrodes Z while 0[V] is applied to the address electrodes X. When the falling ramp waveform Ramp-dn is supplied in this manner, a dark discharge in which a light is almost not generated occurs between the scan electrode Y and the sustain electrode Z. Further, between the scan electrode Y and the address electrode Z, a discharge is not generated a region at which the falling ramp waveform Ramp-dn drops and a dark discharge is generated at a lowest point of the falling ramp waveform Ramp-dn. A discharge occurring in such a set-down interval SD allows excessive wall charges unnecessary to the address discharge of wall charges generated upon set-up discharge to be erased. As a result of reviewing a change of wall charges in the set-up interval SU and the set-down interval SD, a change of wall charges on the address electrode X does almost not exist while negative (−) wall charges having been formed on the scan electrode Y is reduced. On the other hand, wall charges having been formed on the sustain electrode Z has positive polarities, but their polarities are inverted into negative polarities as negative wall charges reduced at the scan electrode Y are accumulated.

During the reset period, at least one of the dummy electrodes D1 and D2 is supplied with a rising ramp waveform Ramp-up and a falling ramp waveform Ramp-dn. If an initialization voltage is applied to at least one of the dummy electrodes D1 and D2 during the reset period, then a writing discharge and an erasure discharge are continuously generated at the discharge spaces within the non-display areas 32 and 33.

In the address period, a negative scanning pulse scan is sequentially applied to the scan electrodes Y and, at the same time, a positive data pulse data synchronized with the scanning pulse scan is applied to the address electrodes X. A voltage difference between the scanning pulse scan and the data pulse data is added to the wall voltage generated in the reset period, to thereby generate an address discharge within the cell supplied with the data pulse data. Wall charges enough to cause a discharge when a sustain voltage Vs is supplied are formed within the cells selected by the address discharge. During the address period, a positive direct current voltage Zdc is applied to the scan electrodes Z.

During the address period, the dummy electrodes D1 and D2 are supplied with a ground voltage GND or 0[V]. Thus, a discharge is not generated at the discharge spaces of the non-display areas 32 and 33.

In the sustain period, a sustaining pulse sus are alternately applied to the scan electrodes Y and the sustain electrodes Z. The cells selected by the address discharge generates a sustain discharge, that is, a display discharge between the scan electrode Y and the sustain electrode Z whenever each sustaining pulse sus is applied while a wall voltage within the cell is added to the sustaining pulse sus.

After termination of the sustain discharge, an erasing ramp waveform ramp-ers in which a voltage rises gradually is applied to the sustain electrode Z or is continuously applied to the sustain electrode Z and the scan electrode Y, thereby erasing wall charges left within the cells. Further, the erasing ramp-waveform ramp-ers is applied to at least one of the dummy electrodes D1 and D2, thereby erasing electric charges left at the discharge spaces within the non-display areas 32 and 33.

If a voltage for causing an erasure discharge is applied to at least one of the dummy electrodes D1 and D2 in the reset period and/or the sustain period, then a side abnormal discharge caused by electric charges accumulated within the discharge spaces of the non-display areas 32 and 33 does not occur because the electric charges within the discharge spaces are periodically erased.

Meanwhile, at least one of the dummy electrodes D1 and D2 may be supplied with a voltage suggested by U.S. Pat. No. 6,624,587 filed by the applicant. In other words, the dummy electrodes D1 and D2 may be supplied with a voltage for erasing electric charges left within the discharge spaces of the non-display areas.

In FIG. 9, a voltage for preventing a side abnormal discharge only has been illustrated with respect to a driving voltage applied to the dummy electrodes D1 and D2. As mentioned above, a scanning pulse may be applied to at least one of the dummy electrodes D1 and D2. In this case, charged particles generated at the discharge spaces within the non-display areas permit the cells at the first scan line to make use of a priming effect like other scan lines.

Figure 10A:
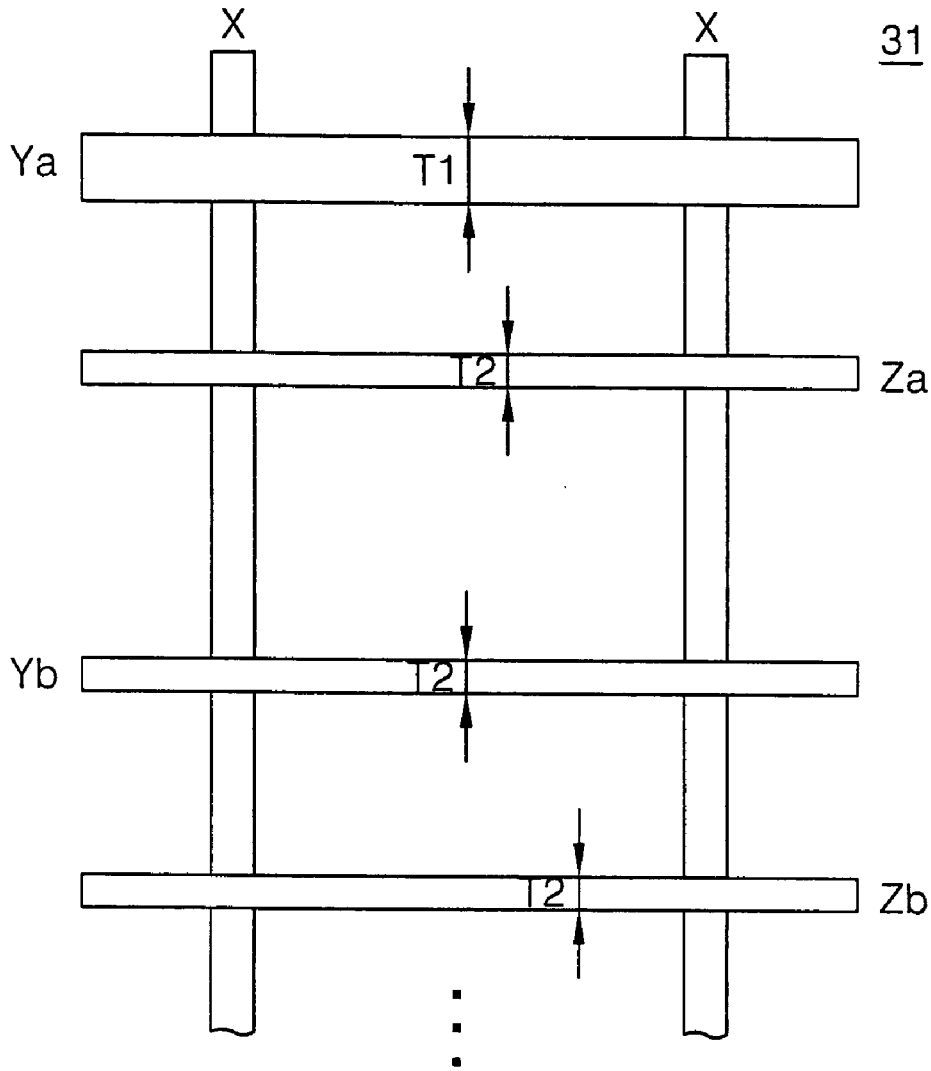
FIG. 10A illustrates a portion of cells in a plasma display according to a third embodiment of the present invention.

FIG. 10A shows a portion of cells in a PDP according to a third embodiment of the present invention.

Referring to FIG. 10A, the PDP according to the third embodiment of the present invention includes a scan electrode Ya of the first scan line having a large width T1. The width T1 of the scan electrode Ya is larger than a width T2 of a sustain electrode Za at the first scan line and is larger than a width T2 of the scan electrode Yb and the sustain electrode Zb at other scan lines. Each scan line is provided with an address electrode X crossing the scan electrodes Ya and Yb and the sustain electrodes Za and Zb.

If the width T1 of the scan electrode Ya included in the first scan line is large as shown in FIG. 10A, then an overlapping area of the scan electrode Ya with the address electrode X becomes large to that extent to thereby increase an amount of wall charges formed on the scan electrode Y and the address electrode X upon address discharge. Accordingly, the first scan line allows a voltage margin of a voltage required for an address discharge to be widened like other scan lines capable of utilizing a priming effect and permits a stable sustain discharge.

Figure 10B:
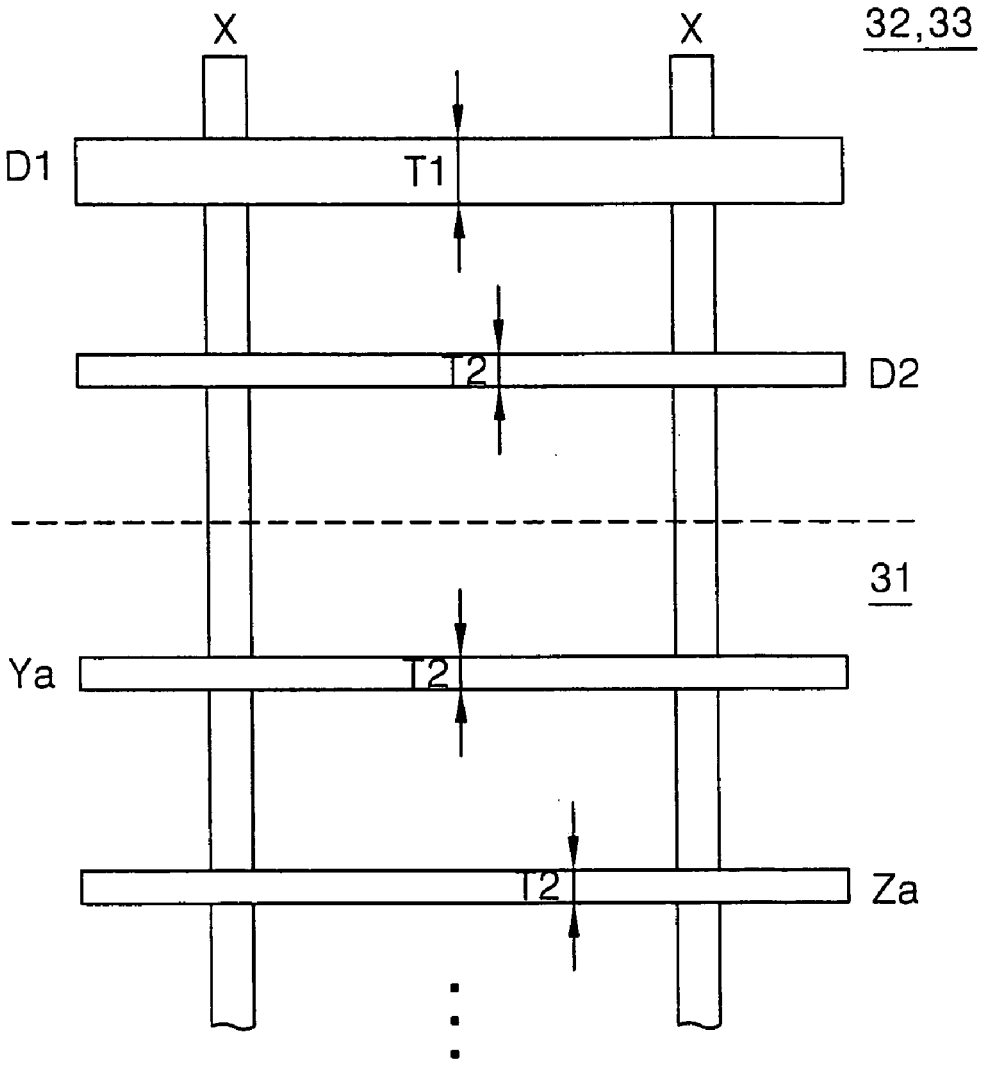
FIG. 10B illustrates a portion of cells in a plasma display according to a fourth embodiment of the present invention.

FIG. 10B shows a portion of cells in a PDP according to a fourth embodiment of the present invention.

Referring to FIG. 10B, in the PDP according to the fourth embodiment of the present invention, a width T1 of the first dummy electrode D1 adjacent to the second dummy electrode D2 is larger than that of the second dummy electrode D2 adjacent to a scan electrode Ya at the first scan line. The width T1 of the first dummy electrode D1 is larger than a width T2 of the scan electrode Ya and the sustain electrode Za at the first scan line and also is larger than a width T2 of the adjacent second dummy electrode D2.

Each scan line of the display area 31 and the non-display areas 32 and 33 are provided with an address electrode X crossing the scan electrode Ya, the sustain electrode Za and the dummy electrodes D1 and D2.

If the width of the first dummy electrode D1 is large as shown in FIG. 10B, then an overlapping area of the dummy electrode D1 with the address electrode X becomes large to that extent to thereby increase an amount of electric charges generated by the discharge. Accordingly, the first scan line can cause an address discharge using a lot of electric charges moved from the discharge spaces of the non-display areas 32 and 33. Further, if a width of the dummy electrode D1 supplied with an erasure voltage simultaneously with the scan electrode Ya at the first scan line as shown in FIG. 10B, then a stable erasure discharge can be generated within the discharge spaces of the non-display areas 32 and 33.

Figure 11A:
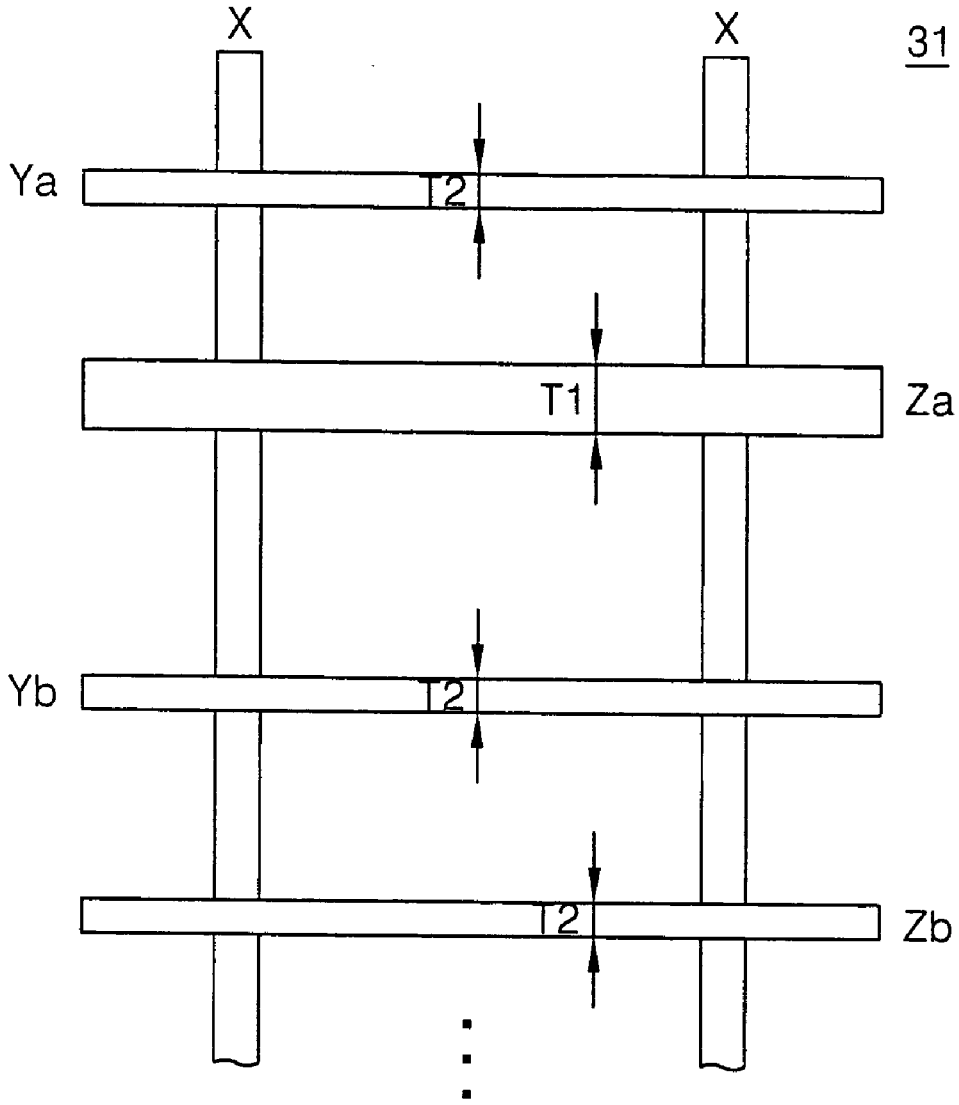
FIG. 11A illustrates a portion of cells in a plasma display according to a fifth embodiment of the present invention.

FIG. 11A shows a portion of cells in a PDP according to a fifth embodiment of the present invention. Referring to FIG. 11A, the PDP according to the fifth embodiment of the present invention includes a sustain electrode Za of the first scan line having a large width T1. The width T1 of the sustain electrode Za is larger than a width T2 of a scan electrode Ya at the first scan line and is larger than a width T2 of the scan electrode Yb and the sustain electrode Zb at other scan lines. Each scan line is provided with an address electrode X crossing the scan electrodes Ya and Yb and the sustain electrodes Za and Zb.

If the width T1 of the sustain electrode Za included in the first scan line is large as shown in FIG. 11A, then more negative wall charges are accumulated in the reset period to thereby stabilize a sustain discharge even though an unstable address discharge is generated at the cell of the first scan line. In other words, a lot of negative wall charges have been accumulated onto the sustain electrode Za even though a sufficient amount of positive wall charges fail to be accumulated onto the scan electrode Ya as a result of a weak address discharge, so that a voltage difference between the scan electrode Ya and the sustain electrode Za can be enlarged when a first sustaining pulse is applied to the scan electrode Ya, thereby causing a stable sustain discharge.

Figure 11B:
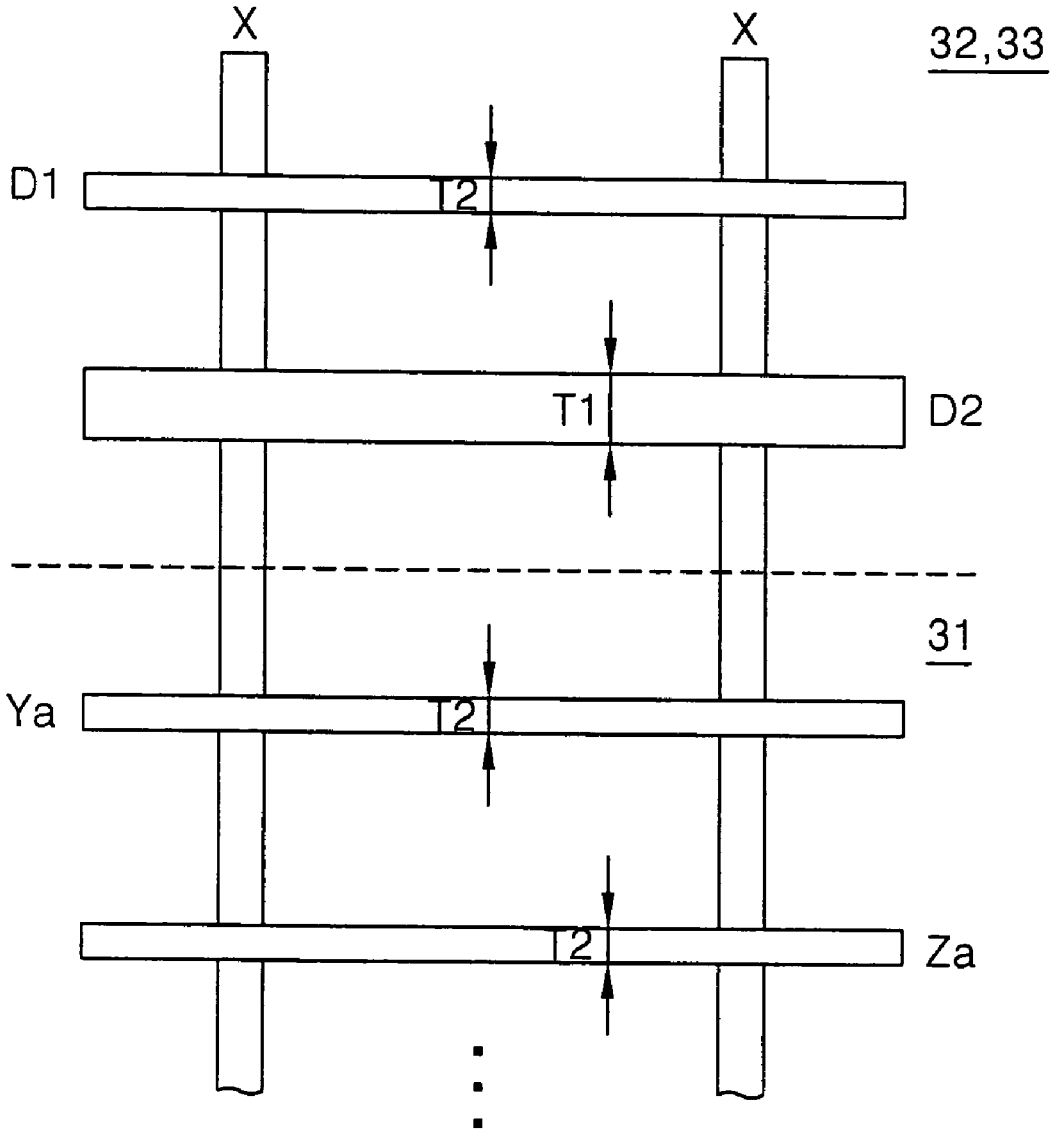
FIG. 11B illustrates a portion of cells in a plasma display according to a sixth embodiment of the present invention.

FIG. 11B shows a portion of cells in a PDP according to a sixth embodiment of the present invention.

Referring to FIG. 11B, in the PDP according to the sixth embodiment of the present invention, a width T1 of the second dummy electrode D2 adjacent to a scan electrode Ya at the first scan line is larger than that of the first dummy electrode D1. The width T1 of the second dummy electrode D2 is larger than a width T2 of the scan electrode Ya and the sustain electrode Za at the first scan line and also is larger than a width T2 of the adjacent first dummy electrode D1.

Each scan line of the display area 31 and the non-display areas 32 and 33 are provided with an address electrode X crossing the scan electrode Ya, the sustain electrode Za and the dummy electrodes D1 and D2.

Likewise the fourth embodiment of the present invention, if the width of the second dummy electrode D2 is large as shown in FIG. 11B, then an overlapping area of the dummy electrode D2 with the address electrode X becomes large to that extent to thereby increase an amount of electric charges generated by the discharge. Accordingly, the first scan line can cause an address discharge using a lot of electric charges moved from the discharge spaces of the non-display areas 32 and 33. Further, if a width of the dummy electrode D2 supplied with an erasure voltage simultaneously with the scan electrode Ya at the first scan line as shown in FIG. 10B, then a stable erasure discharge can be generated within the discharge spaces of the non-display areas 32 and 33.

Figure 12A:
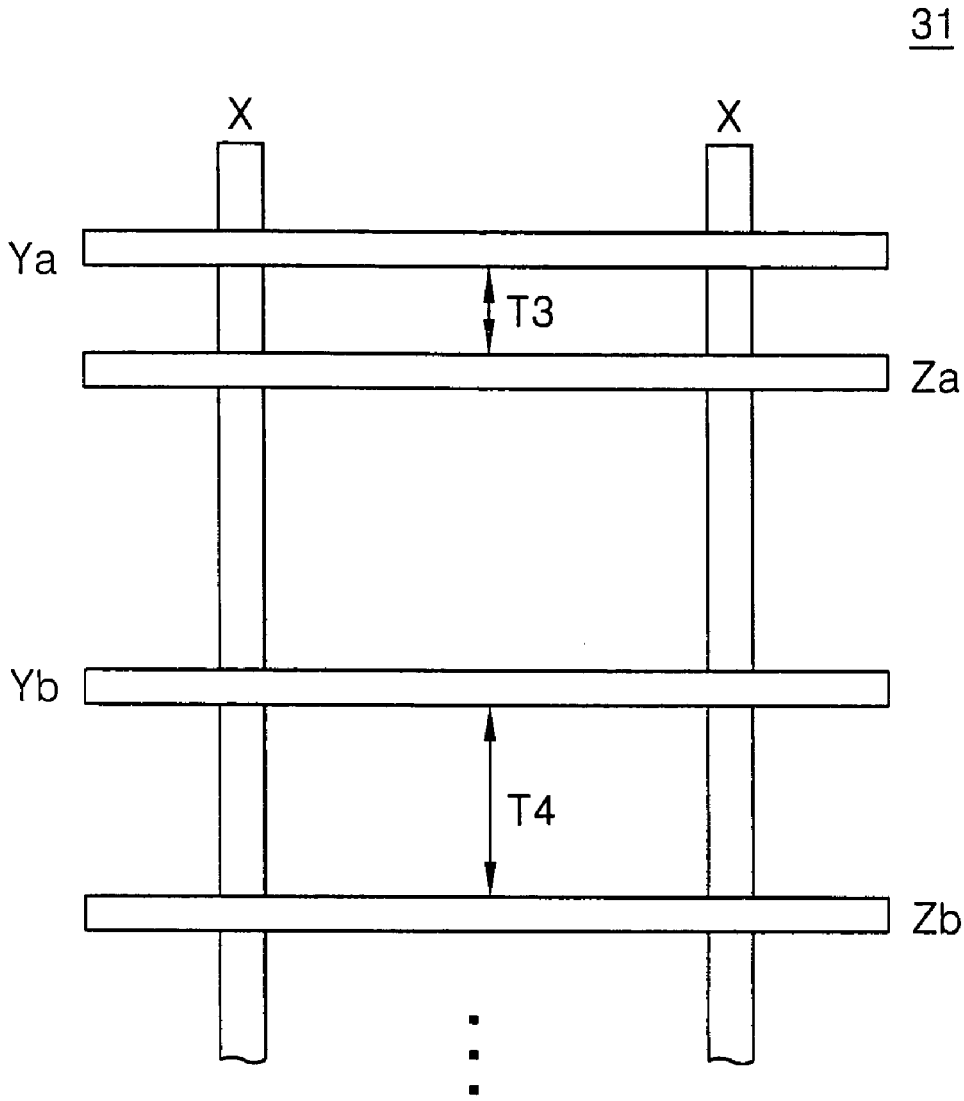
FIG. 12A illustrates a portion of cells in a plasma display according to a seventh embodiment of the present invention.

FIG. 12A shows a portion of cells in a PDP according to a seventh embodiment of the present invention.

Referring to FIG. 12A, the PDP according to the seventh embodiment of the present invention includes a scan electrode Ya and a sustain electrode Za of the first scan line having a smaller gap T3 than other scan lines. The gap T3 between the scan electrode Ya and the sustain electrode Za provided at the first scan line is narrower than a gap T4 between the scan electrode Yb and the sustain electrode Zb provided at other scan lines.

Each scan line of a display area 31 is provided with an address electrode X crossing the scan electrodes Ya and Yb and the sustain electrodes Za and Zb.

If the gap T3 between the scan electrode Ya and the sustain electrode Za provided at the first scan line is narrower than that at other scan lines, then a discharge voltage proportional to a gap between the electrodes is lowered. Accordingly, an easy and stable discharge is generated at the cells of the first scan line without any priming effect. For instance, even though a small amount of wall charges are accumulated onto the scan electrode Ya as a result of a weak address discharge generated at the first scan line, a stable sustain discharge can occur at a low voltage.

Figure 12B:
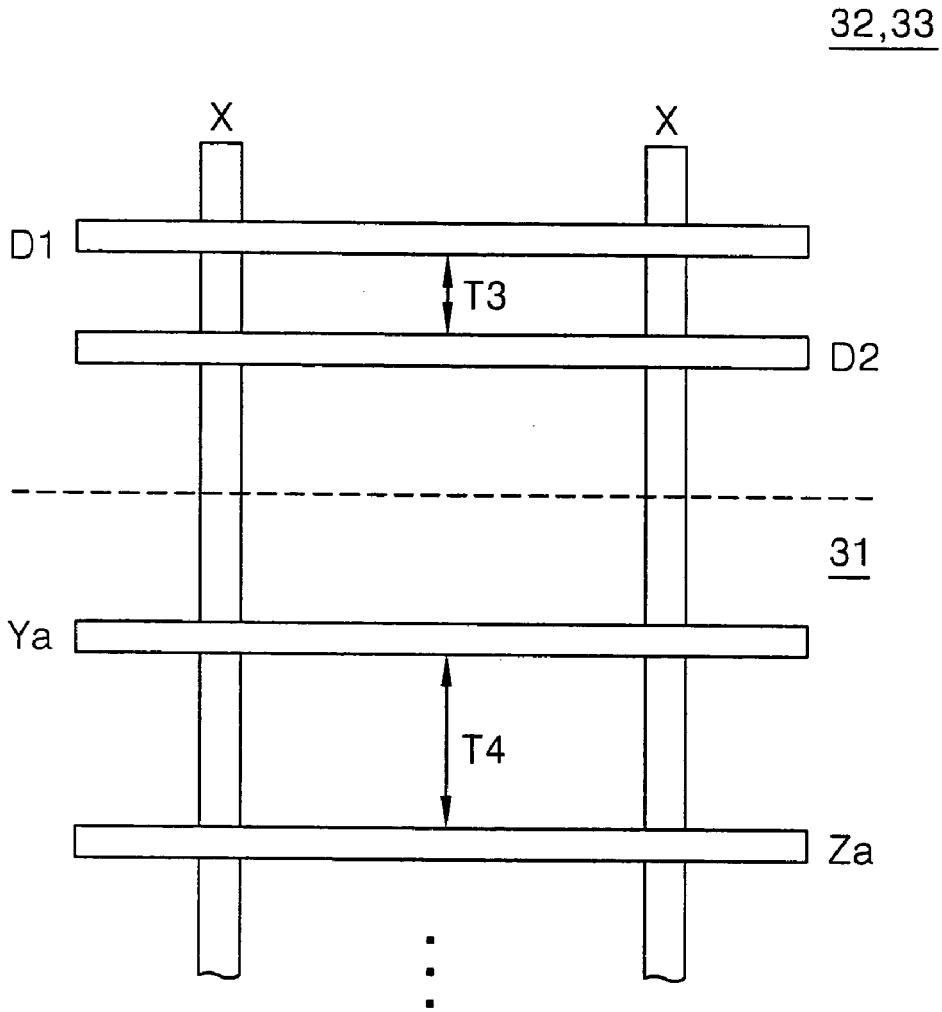
FIG. 12B illustrates a portion of cells in a plasma display according to an eighth embodiment of the present invention.

Referring to FIG. 12B, the PDP according to the eighth embodiment of the present invention includes dummy electrodes D1 and D2 having a smaller gap T3 than scan lines of an effective display area 31.

Each scan line of the display area 31 and the non-display areas 32 and 33 are provided with an address electrode X crossing the scan electrode Ya, the sustain electrode Za and the dummy electrodes D1 and D2.

If the gap T3 between the dummy electrodes D1 and D2 is narrow as shown in FIG. 12B, then a discharge voltage is lowered to thereby cause a strong discharge between the dummy electrodes D1 and D2 even at a relatively low voltage. Accordingly, an amount of charged particles generated upon discharge between the dummy electrodes D1 and D2 is increased, so that a sufficient amount of priming charged particles are supplied to the cells of the first scan line.

Figure 13A:
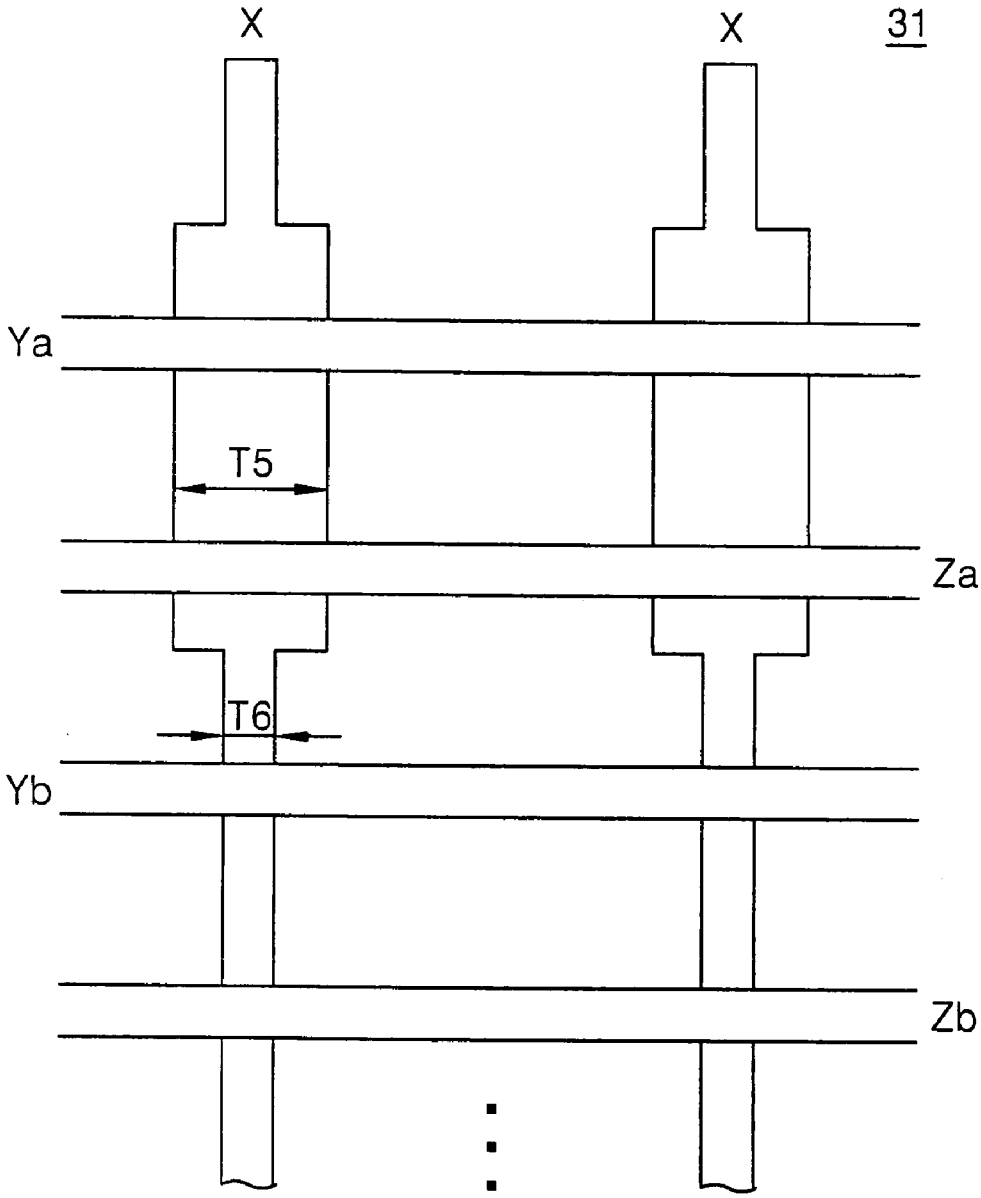
FIG. 13A illustrates a portion of cells in a plasma display according to a ninth embodiment of the present invention.

FIG. 13A shows a portion of cells in a PDP according to a ninth embodiment of the present invention.

Referring to FIG. 13A, the PDP according to the ninth embodiment of the present invention includes an address electrode X in which a width T5 of a portion overlapping with a scan electrode Ya and a sustain electrode Za at the first scan line is larger than that of a portion overlapping with a scan electrode Yb and a sustain electrode Zb at other scan lines.

In the reset period, an initialization waveform applied to the scan electrodes Ya and Yb as shown in FIG. 9 causes an initialization discharge between the scan electrodes Ya and Yb and the sustain electrodes Za and Zb and between the scan electrodes Ya and Yb and the address electrodes X.

In the address period, the address electrode X is supplied with a data pulse synchronized with a scanning pulse. With the aid of a voltage difference between the scanning pulse and the data pulse and wall charges formed by an initialization discharge, an address discharge is generated between the scan electrodes Ya and Yb and the address electrodes X.

If a width of the address electrode X at a portion crossing the scan electrode Ya and the sustain electrode Za of the first scan line is large as shown in FIG. 13A, then positive wall charges generated upon initialization discharge are more accumulated onto the address electrode X overlapping with the scan electrode Ya and the sustain electrode Za of the first scan line than other scan lines. Accordingly, the cells of the first scan line causes a stable address discharge at a relatively low data voltage and scan voltage without any priming effect.

Figure 13B:
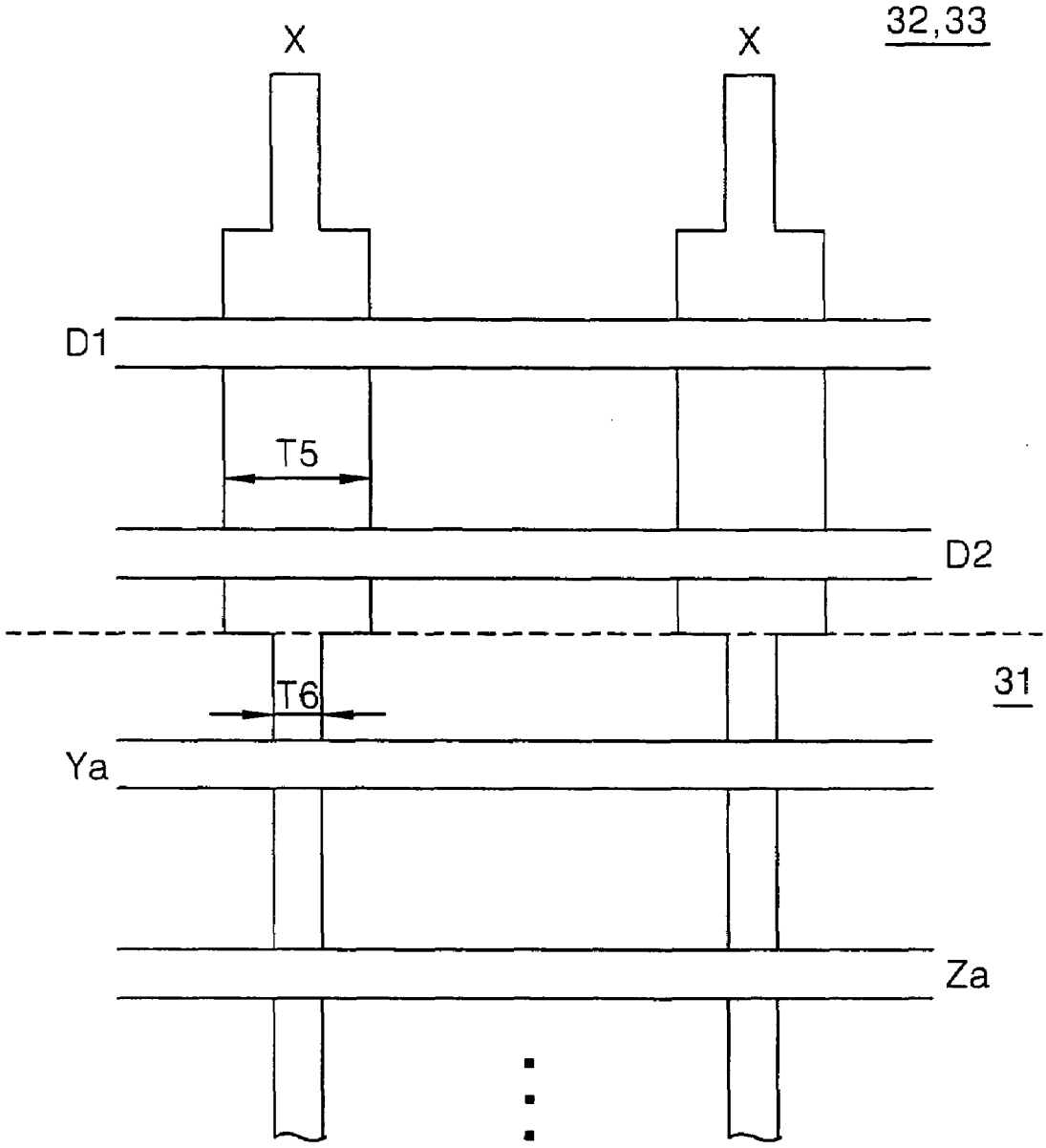
FIG. 13B illustrates a portion of cells in a plasma display according to a tenth embodiment of the present invention.

FIG. 13B shows a portion of cells in a PDP according to a tenth embodiment of the present invention.

Referring to FIG. 13B, the PDP according to the tenth embodiment of the present invention includes an address electrode X having a larger width T5 than its portion overlapping with a scan electrode Ya and a sustain electrode Za provided at scan lines of a display area 31 and than dummy electrodes D1 and D2 of non-display areas 32 and 33.

If the width T5 of the address electrode X at a portion overlapping with the dummy electrodes D1 and D2 is large as shown in FIG. 13B, then a strong discharge between at least one of the dummy electrodes D1 and D2 and the address electrode X is generated at the discharge spaces of the non-display areas 32 and 33 even at a relatively low voltage. Accordingly, an amount of charged particles produced upon discharge between at least one of the dummy electrodes D1 and D2 and the address electrode X is increased, thereby supplying a sufficient amount of priming charged particles to the cells of the first scan line.

Figure 14A:
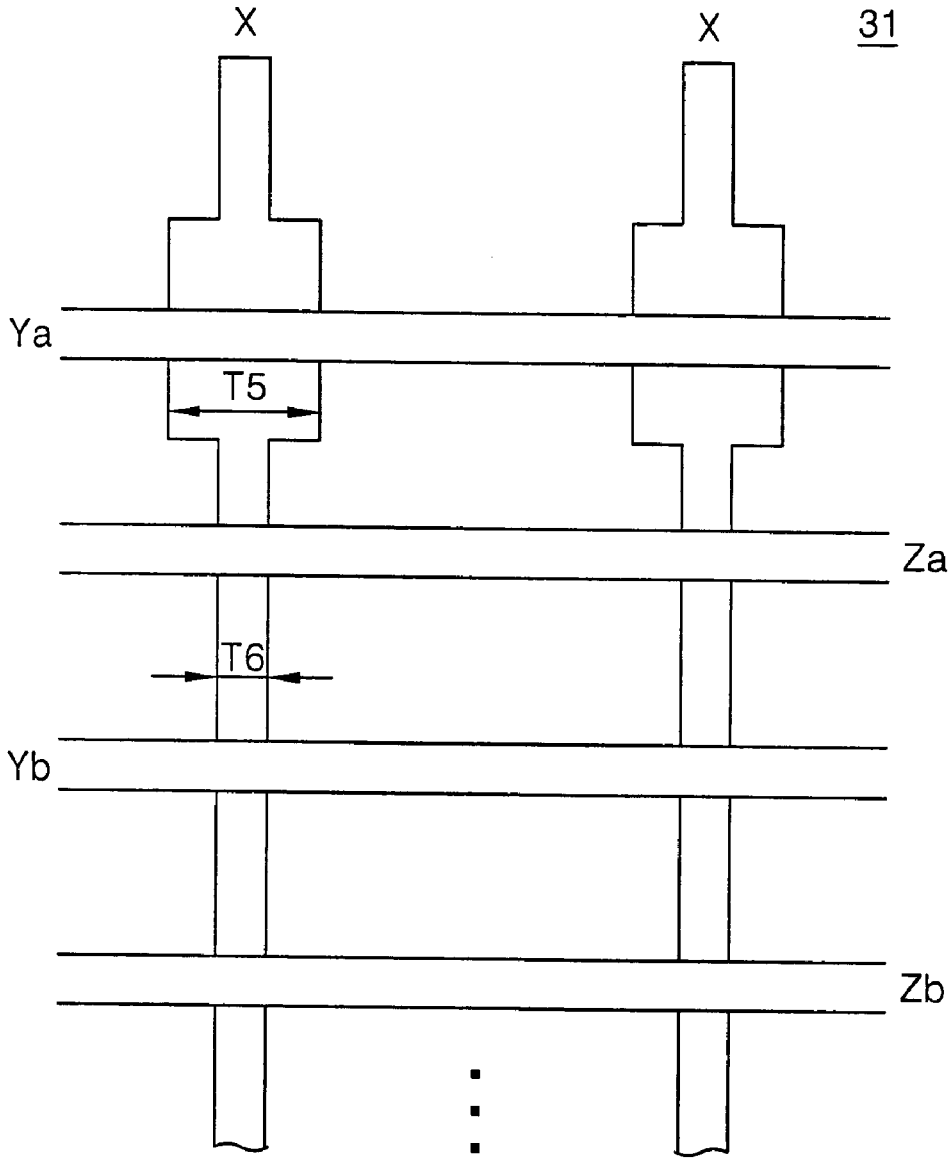
FIG. 14A illustrates a portion of cells in a plasma display according to an eleventh embodiment of the present invention.

FIG. 14A shows a portion of cells in a PDP according to a eleventh embodiment of the present invention.

Referring to FIG. 14A, the PDP according to the eleventh embodiment of the present invention includes an address electrode X in which a width T5 of a portion overlapping with a scan electrode Ya and a sustain electrode Za at the first scan line is larger than that of a portion overlapping with a scan electrode Yb and a sustain electrode Zb at other scan lines.

Likewise the ninth embodiment of the present invention, if a width of the address electrode X at a portion crossing the scan electrode Ya of the first scan line is large as shown in FIG. 14A, then positive wall charges generated upon initialization discharge are more accumulated onto the address electrode X overlapping with the scan electrode Ya of the first scan line than other scan lines. Accordingly, the cells of the first scan line causes a stable address discharge at a relatively low data voltage and scan voltage without any priming effect.

Figure 14B:
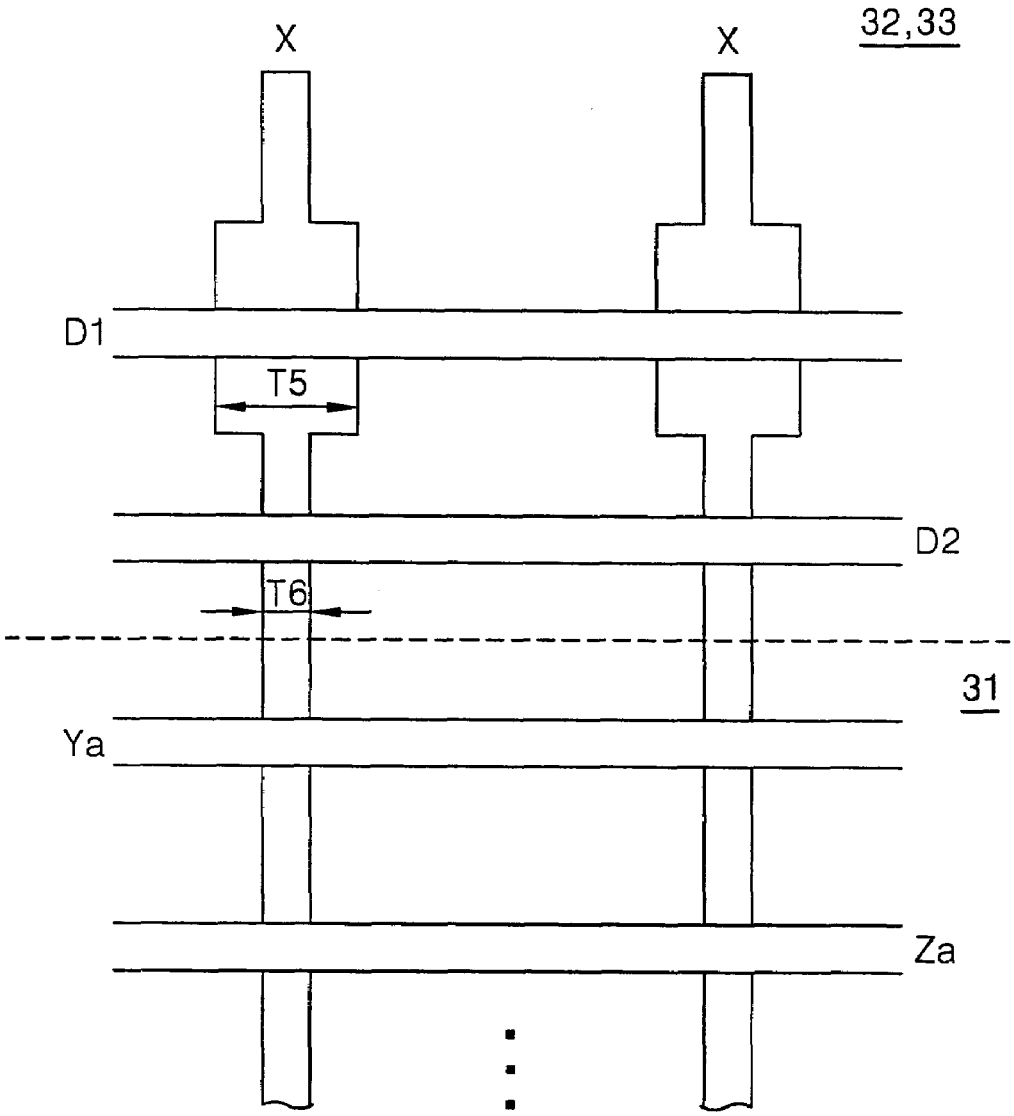
FIG. 14B illustrates a portion of cells in a plasma display according to a twelfth embodiment of the present invention.

FIG. 14B shows a portion of cells in a PDP according to a twelfth embodiment of the present invention.

Referring to FIG. 14B, the PDP according to the twelfth embodiment of the present invention includes an address electrode X having a larger width T5 than its portion overlapping with a second dummy electrode D2 adjacent to a scan electrode Ya at a display area 31 and its portion overlapping with a scan electrode Yb and a sustain electrode Zb at the display area 31 and than a first dummy electrode D1 adjacent to the second dummy electrode D2.

Likewise the tenth embodiment of the present invention, if the width T5 of the address electrode X at a portion overlapping with the first dummy electrode D1 is large, then a strong discharge between the first dummy electrode D1 and the address electrode X is generated at discharge spaces of non-display areas 32 and 33 even at a relatively low voltage. Accordingly, an amount of charged particles produced upon discharge between the first dummy electrode D1 and the address electrode X is increased, thereby supplying a sufficient amount of priming charged particles to the cells of the first scan line.

Figure 15A:
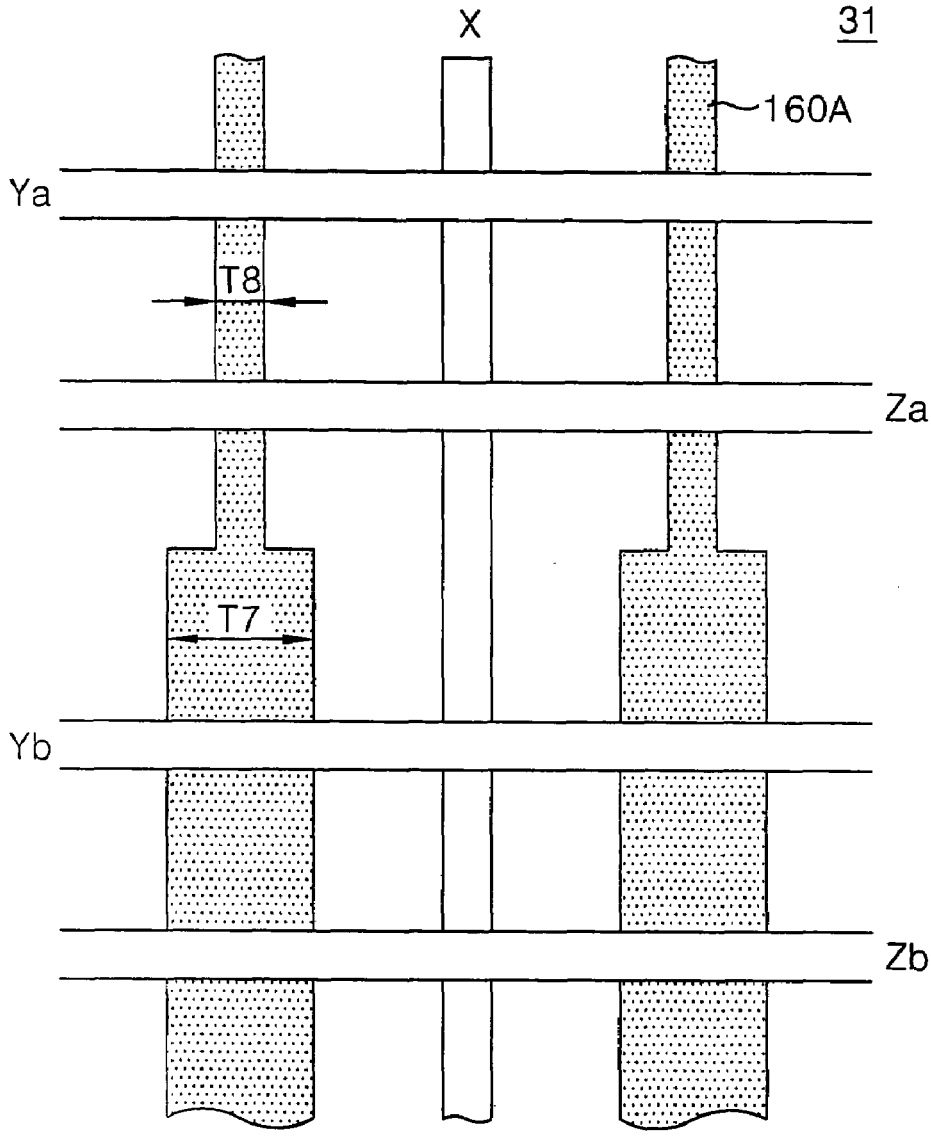
FIG. 15A illustrates a portion of cells in a plasma display according to a thirteenth embodiment of the present invention.

FIG. 15A shows a portion of cells in a PDP according to a thirteenth embodiment of the present invention.

Referring to FIG. 15A, the PDP according to the thirteenth embodiment of the present invention includes a barrier rib 160*a* in which a width T8 of a portion overlapping with a scan electrode Ya and a sustain electrode Za at the first scan line is smaller than that of a portion overlapping with a scan electrode Yb and a sustain electrode Zb at other scan lines.

If the width T8 of the barrier rib 160*a* at a portion overlapping with the scan electrode Ya and the sustain electrode Za of the first scan line is smaller than a width T7 at a portion overlapping with other scan lines as shown in FIG. 15A, then a discharge space within the cells provided at the first scan line is larger than that within the cells provided at other scan lines. If the discharge space becomes larger, then a discharge is diffused within a wider space to thereby increase an amount of charged particles formed by the discharge. Accordingly, the cells of the first scan line causes a stable address discharge at a relatively low voltage without any priming effect.

Figure 15B:
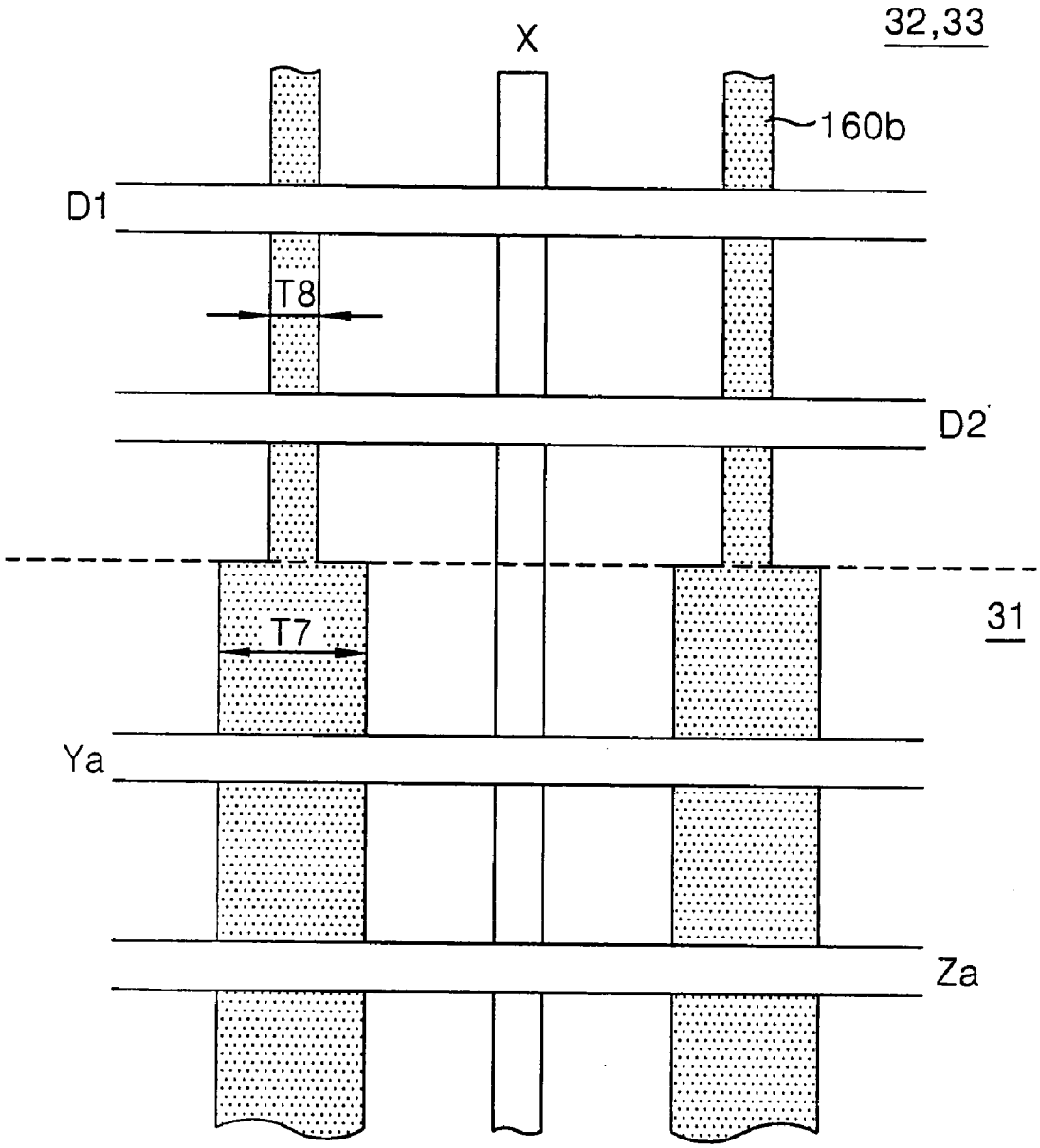
FIG. 15B illustrates a portion of cells in a plasma display according to a fourteenth embodiment of the present invention.

FIG. 15B shows a portion of cells in a PDP according to a fourteenth embodiment of the present invention.

Referring to FIG. 15B, the PDP according to the fourteenth embodiment of the present invention includes a barrier rib 160*b* having a smaller width T8 at non-display areas 32 and 33 than at a display area 31.

If the width T8 of the barrier rib 160*b* at the non-display areas 32 and 33 is small as shown in FIG. 15B, then discharge spaces within the non-display areas 32 and 33 are enlarged to thereby cause a strong discharge at the discharge spaces of the non-display areas 32 and 33 even at a relatively low voltage. Accordingly, an amount of charged particles produced upon discharge at the discharge spaces provided within the non-display areas 32 and 33 is increased, thereby supplying a sufficient amount of priming charged particles to the cells of the first scan line.

Figure 16A:
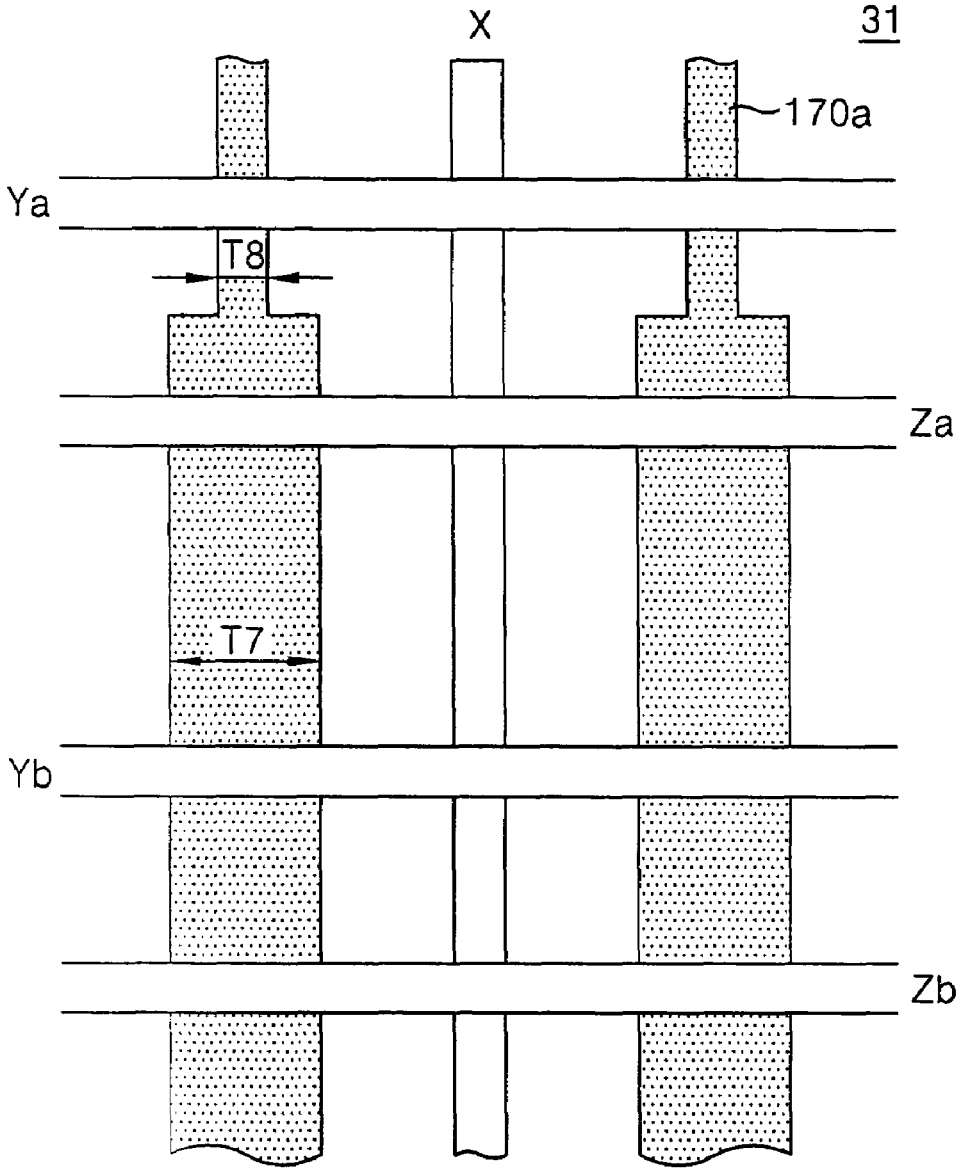
FIG. 16A illustrates a portion of cells in a plasma display according to a fifteenth embodiment of the present invention.

FIG. 16A shows a portion of cells in a PDP according to a fifteenth embodiment of the present invention.

Referring to FIG. 16A, the PDP according to the fifteenth embodiment of the present invention includes a barrier rib 170*a* in which a width T8 of a portion overlapping with a scan electrode Ya at the first scan line is larger than that of a portion overlapping with a sustain electrode Za at the first scan line and a scan electrode Yb and a sustain electrode Zb at other scan lines.

If the width T8 of the barrier rib 170*a* at a portion overlapping with the scan electrode Ya of the first scan line is small as shown in FIG. 16A, then a discharge space within the cells provided at the first scan line is enlarged, thereby causing a strong discharge, particularly, a strong address discharge at the discharge space.

Figure 16B:
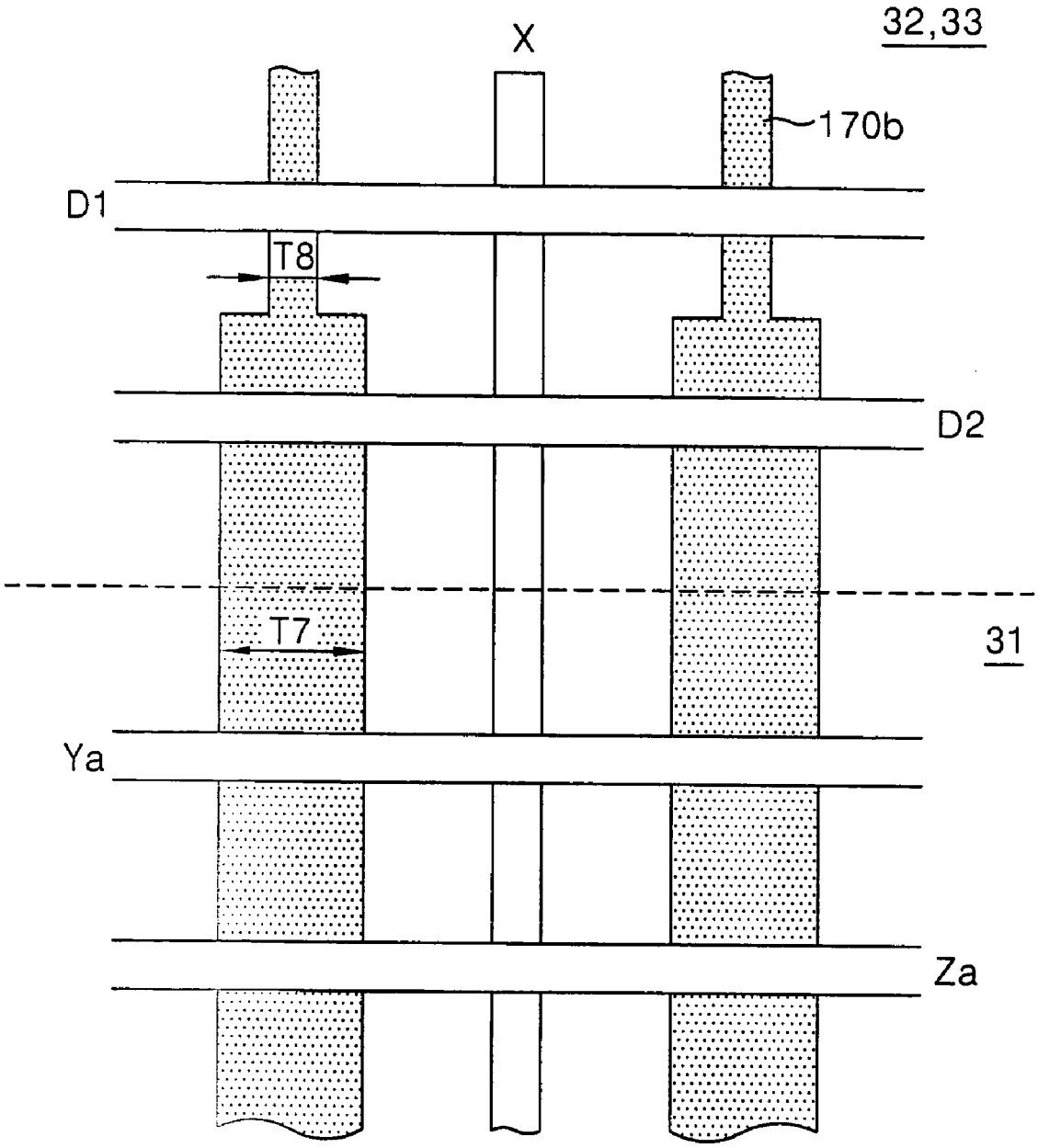
FIG. 16B illustrates a portion of cells in a plasma display according to a sixteenth embodiment of the present invention.

FIG. 16B shows a portion of cells in a PDP according to a sixteenth embodiment of the present invention.

Referring to FIG. 16B, the PDP according to the sixteenth embodiment of the present invention includes a barrier rib 160*b* having a smaller width T8 at non-display areas 32 and 33 overlapping with a first dummy electrode D1 than at a display area 31 and a portion of the non-display areas 32 and 33 adjacent thereto.

Charged particles produced at the discharge space expanded from one side of the non-display areas 32 and 33 as shown in FIG. 16B are more increased than those at a relatively narrower discharge space. Accordingly, charged particles produced at the non-display areas 32 and 33 are increased, so that the cells of the first scan line are supplied with a sufficient amount of priming charged particles.

Figure 17A:
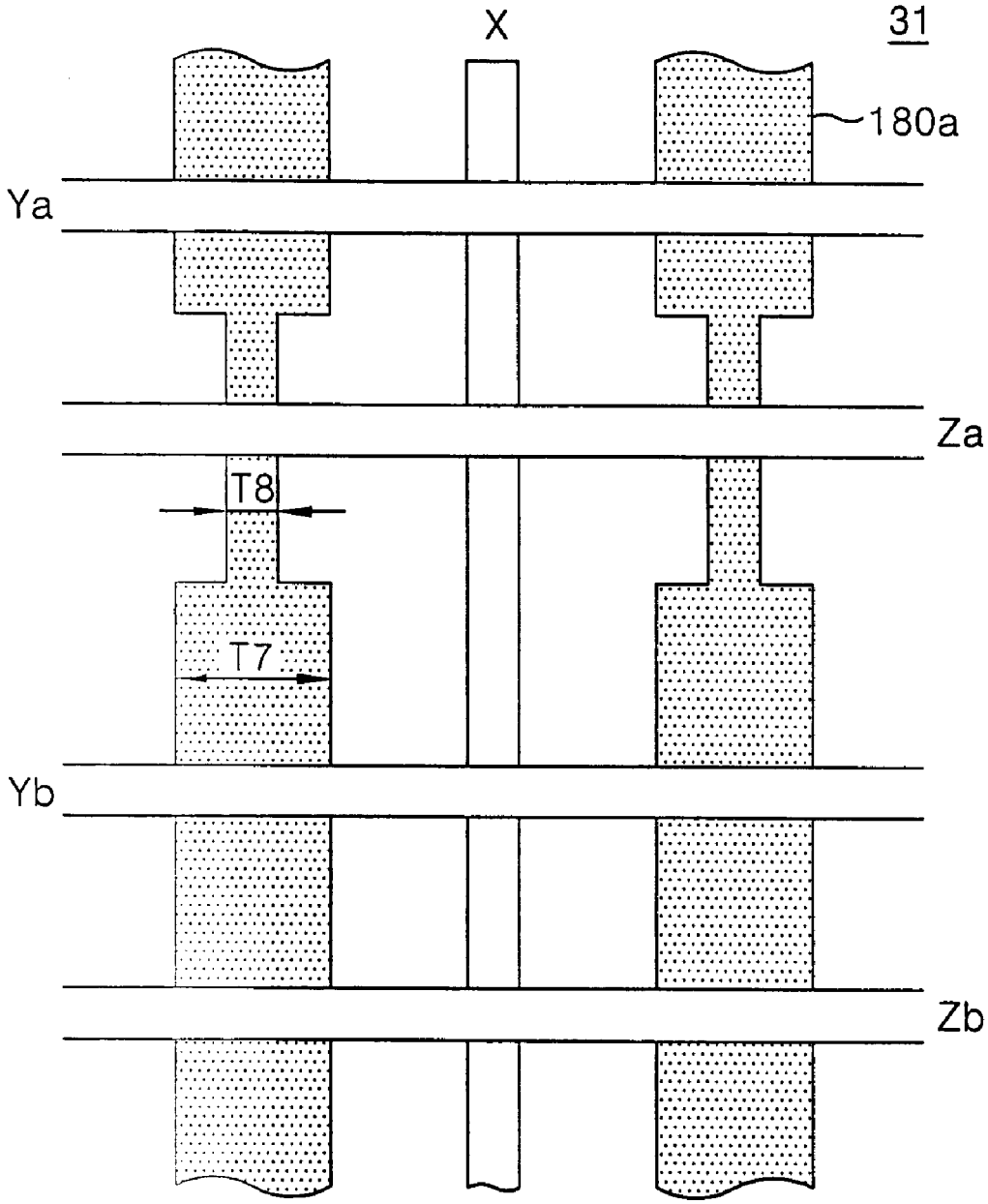
FIG. 17A illustrates a portion of cells in a plasma display according to a seventeenth embodiment of the present invention.

FIG. 17A shows a portion of cells in a PDP according to a seventeenth embodiment of the present invention.

Referring to FIG. 17A, the PDP according to the seventeenth embodiment of the present invention includes a barrier rib 180*a* in which a width T8 of a portion overlapping with a sustain electrode Za at the first scan line is smaller than that of a portion overlapping with a scan electrode Ya at the first scan line and a scan electrode Yb and a sustain electrode Zb at other scan lines.

If the width T8 of the barrier rib 180*a* at a portion overlapping with the sustain electrode Za of the first scan line is small as shown in FIG. 17A, then a discharge space within the cells provided at the first scan line is enlarged, thereby causing a strong discharge within the cells provided at the first scan line like the above-mentioned embodiment.

Figure 17B:
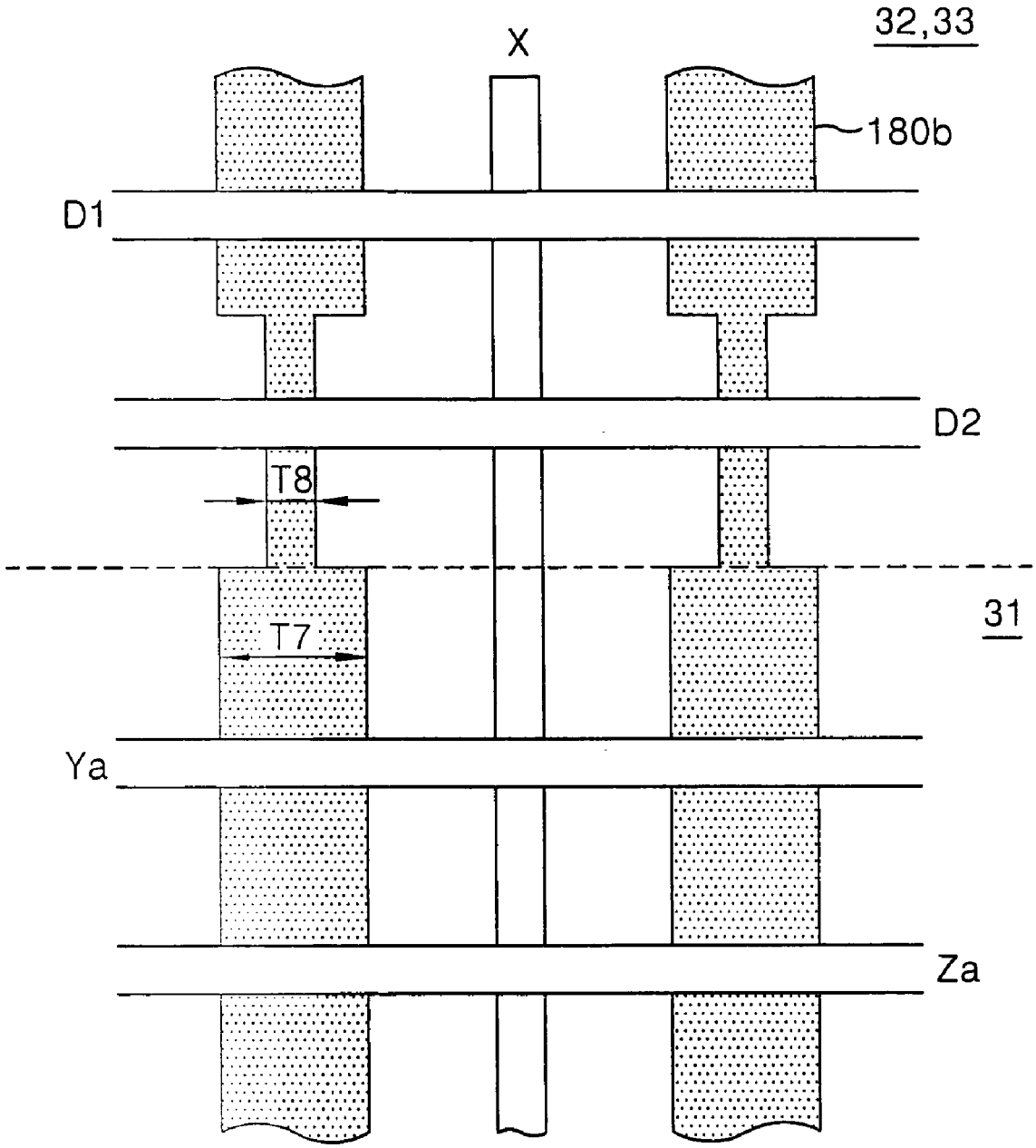
FIG. 17B illustrates a portion of cells in a plasma display according to an eighteenth embodiment of the present invention.

FIG. 17B shows a portion of cells in a PDP according to an eighteenth embodiment of the present invention.

Referring to FIG. 17B, the PDP according to the eighteenth embodiment of the present invention includes a barrier rib 180*b* having a smaller width T8 at non-display areas 32 and 33 overlapping with a second dummy electrode D2 than at a display area 31 and a portion of the non-display areas 32 and 33 overlapping with a first dummy electrode D1.

Charged particles produced at the discharge space expanded from one side of the non-display areas 32 and 33 as shown in FIG. 17B are more increased than those at a relatively narrower discharge space. Accordingly, charged particles produced at the non-display areas 32 and 33 are increased, so that the cells of the first scan line are supplied with a sufficient amount of priming charged particles.

The cell structure and the electrode structure of the first scan line disclosed in the embodiments of the present invention are applicable to the first scan lines in both a PDP adopting a single scan scheme and a PDP adopting a double scan scheme.

Further, all the dummy electrodes D1 and D2 disclosed in the above-mentioned embodiments may be supplied with a dummy electrode voltage as shown in FIG. 9.

As described above, according to the present invention, a width of at least one of the electrodes provided at the first scan line or provided at the discharge spaces of the non-display areas adjacent thereto is established widely, or a distance between the electrodes is narrowed, or the scan line and the discharge spaces of the non-display areas are expanded. As a result, a stable discharge can be generated at the first scan line. Furthermore, an erasure discharge is caused at the discharge spaces of the non-display areas adjacent to the display area, thereby prevent a generation of side abnormal discharge.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display provided with a plurality of scan lines, comprising:

a plurality of electrodes provided at the respective scan lines, wherein said electrodes includes:

a scan electrode supplied with a scanning voltage for selecting the scan lines;

a sustain electrode parallel to the scan electrode; and an address electrode crossing the scan electrode and the sustain electrode and supplied with a data voltage synchronized with the scanning voltage, wherein a width of a portion of the address electrode provided at a first scan line is different from a width of another portion of the address electrode provided at a second scan line.

2. The plasma display as claimed in claim 1, wherein the portion of the address electrode is a portion of the address electrode crossing the scan electrode at the first scan line, and the another portion of the address electrode includes a portion of the address electrode crossing the sustain electrode at the first scan line.

3. The plasma display as claimed in claim 1, wherein sustaining pulses are alternatively applied to the scan electrode and the sustain electrode during a sustaining period.

4. The plasma display as claimed in claim 1, wherein the plurality of scan lines are selected sequentially.

5. The plasma display as claimed in claim 1, wherein the portion of the address electrode is provided in a non-display area of the plasma display.

6. The plasma display as claimed in claim 5, wherein the another portion of the address electrode is provided in a display area of the plasma display.

7. A plasma display provided with a plurality of scan lines, comprising:

a plurality of electrodes provided at the respective scan lines, said electrodes including:

a scan electrode supplied with a scanning voltage for selecting the scan lines;

a sustain electrode parallel to the scan electrode, wherein sustaining pulses are alternately applied to the scan electrode and the sustain electrode during a sustaining period to generate a sustain discharge; and a plurality of address electrodes crossing the scan electrode and the sustain electrode and supplied with a data voltage synchronized with the scanning voltage, wherein a first width of one of the address electrodes at a first scan line is different from a second width of another one of the address electrodes at a second scan line, and a width of at least one of the scan electrode and the sustain electrode at the first scan line is larger than a width of the other one of the scan electrode and the sustain electrode at said second scan line.

8. The plasma display as claimed in claim 7, wherein the first width of the one of the address electrodes is greater than the second width of the other one of the address electrodes.

9. The plasma display as claimed in claim 7, wherein the plasma display includes a plurality of cells, and each cell includes only one sustain electrode and only one scan electrode.

10. The plasma display as claimed in claim 9, wherein each cell also includes only one address electrode.

11. The plasma display as claimed in claim 7, wherein the first scan line is provided in a non-display area of the plasma display.

12. The plasma display as claimed in claim 11, wherein the first scan line comprises a dummy electrode.

13. The plasma display as claimed in claim 11, wherein the second scan line is provided in a display area of the plasma display.

14. The plasma display as claimed in claim 11, wherein the second scan line is provided in the non-display area of the plasma display.

15. The plasma display as claimed in claim 14, wherein the second scan line comprises a dummy electrode.

16. A plasma display provided with a plurality of scan lines, comprising:

a plurality of electrodes provided at the respective scan lines, said electrodes including:

a scan electrode supplied with a scanning voltage for selecting the scan lines;

a sustain electrode parallel to the scan electrode, wherein sustaining pulses are alternately applied to the scan electrode and the sustain electrode during a sustaining period to generate a sustain discharge; and at least two address electrodes crossing the scan electrode and the sustain electrode and supplied with a data voltage synchronized with the scanning voltage, wherein a first width of at least one of the address electrodes at a first one of the scan lines is different from a second width of another one of the address electrodes at a second one of the scan lines.

17. The plasma display as claimed in claim 16, wherein the plasma display includes a plurality of cells, and each cell includes only one sustain electrode, only one scan electrode and only one address electrode.

18. The plasma display as claimed in claim 16, wherein the first width of the one of the address electrodes is greater than the second width of the another one of the address electrodes.

19. The plasma display as claimed in claim 16, wherein the first one of the scan lines is provided in a non-display area of the plasma display.

20. The plasma display as claimed in claim 19, wherein the first one of the scan lines comprises a dummy electrode.

21. The plasma display as claimed in claim 19, wherein the second one of the scan lines is provided in a display area of the plasma display.

22. The plasma display as claimed in claim 19, wherein the second of the scan lines is provided in the non-display area of the plasma display.

* * * * *